US006471143B2

(12) United States Patent
Matsuzawa et al.

(10) Patent No.: US 6,471,143 B2
(45) Date of Patent: Oct. 29, 2002

(54) INJECTOR

(75) Inventors: Hironori Matsuzawa; Rokurou Ozaki; Tomoko Shibata, all of Aichi (JP)

(73) Assignee: Advance Denki Kougyou Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/837,516

(22) Filed: Apr. 19, 2001

(65) Prior Publication Data

US 2002/0125342 A1 Sep. 12, 2002

(30) Foreign Application Priority Data

May 1, 2000 (JP) ..... 2000-132305
Mar. 15, 2001 (JP) ..... 2001-074509

(51) Int. Cl.[7] ..... B05B 1/08

(52) U.S. Cl. ..... 239/101; 239/71; 239/99; 239/533.1; 239/569

(58) Field of Search ..... 239/533.1, 71, 239/99, 101, 569, 574

(56) References Cited

U.S. PATENT DOCUMENTS 3,883,075 A * 5/1975 Edney ..... 239/101
4,077,569 A * 3/1978 Deines ..... 239/101
5,465,905 A * 11/1995 Elder ..... 239/99

* cited by examiner

*Primary Examiner*—Steven J. Ganey
(74) *Attorney, Agent, or Firm*—Rader, Fishman & Grauer PLLC

(57) ABSTRACT

An injector is disclosed, in which the change in the internal pressure of each chamber is relaxed when a pressure application mechanism is reciprocating thereby to lengthen the service life of the component parts including a diaphragm portion. The injector (I) comprises a body B including therein a first outer inlet portion (13) for a pressured fluid (F), a first outer outlet portion (14), a connecting inlet portion (21) communicating with the first outer inlet portion or the first outer outlet portion, a connecting outlet portion (22), a second outer inlet portion (31) communicating with the connecting inlet portion or the connecting outlet portion, a second outer outlet portion (32), a first chamber (40), a second chamber (50), intake check valves (61, 71), discharge check valves (66, 76), a pressure application mechanism (80), a working fluid influx/outlet portion (90) for causing the working fluid (A) for reciprocating the pressure application mechanism to flow into or from at least one of the two chambers, urging diaphragm portions (100, 120) external to the pressure application mechanism (80), and urging units (110, 115, 130, 135) for urging the urging diaphragm portion inward.

11 Claims, 17 Drawing Sheets

(1)

(2)

INJECTOR

BACKGROUND OF THE INVENTION

1. Field of the Invention

The present invention relates to an injector.

2. Description of the Related Art

An injector for sending a fluid such as a chemical liquid or ultrapure water, under pressure, is often built into various apparatuses used, for example, on a semiconductor production line. A conventionally known injector of this type comprises an inlet and an outlet for the fluid to be sent under pressure (hereinafter sometimes referred to as the pressured fluid), two chambers, two inlet portions establishing communication between each chamber and the inlet, a body formed with two outlet portions for establishing communication between each chamber and the outlet, and a pressure application mechanism having at each end thereof a diaphragm to be arranged in each chamber, wherein a working fluid such as a gas is supplied into the chambers so that the pressure application mechanism is reciprocated and the pressured fluid in the chambers is discharged from the outlet.

The injector having the conventional structure described above, however, poses the problem that the internal pressure of each chamber sharply changes when the pressure application mechanism is reciprocated, or especially when switching the supply of the working fluid for reciprocating the pressure application mechanism. This sharp pressure change has caused various inconveniences such as a shortened service life of the component parts including the pressure application mechanism.

Also, in the conventional structure described above, the supply of the working fluid for reciprocating the pressure application mechanism is switched at a time point when a stroke end detecting switch or a sensor built in the body detects the stroke end of the pressure application mechanism, or is switched mechanically utilizing the rise of the internal pressure of the chamber supplied with the working fluid, upon arrival at the stroke end of the pressure application mechanism. As a result, the discharge pressure of the pressured fluid at the outlet is substantially zero when the pressure application mechanism is inverted in operation, thereby undesirably causing a large pulsation in the discharge pressure. Also, the aforementioned switching of the supply of the working fluid for reciprocating the pressure application mechanism makes it very difficult to change the discharge flow rate from the injector. If, for example, that the injector is used for sending the fluid under pressure in a semiconductor production line, a large pulsation is liable to adversely affect the yield of the semiconductor products as the fluid (a liquid in this case) after being scattered and fouled is attached to the semiconductor wafer or causes etching irregularities.

Further, when switching the supply of the working fluid for reciprocating the pressure application mechanism as described above, the diaphragm portion of the pressure application mechanism comes into harsh contact with the inner wall of the chambers upon arrival at the stroke end, thereby shortening the service life of the pressure application mechanism.

Furthermore, in the conventional structure described above, if the pressure application mechanism is stopped with the center thereof displaced from the intermediate position of the longest reciprocation range (reciprocation range for normal operation) thereof when the injector operation is stopped, i.e. when the supply or discharge operation of the working fluid is stopped after restart of the injector operation, the center of the reciprocating motion of the pressure application mechanism is deflected to one of the chambers, with the result that the pressure application mechanism is reciprocated with the reciprocation range thereof changed from that for normal operation. Thus, the discharge flow rate (discharge pressure) changes before and after the operation stop of the injector. Generally, the two chambers are set to the same discharge flow rate. In the case where the center of reciprocation of the pressure application mechanism is displaced after restart of the operation as described above, however, the discharge flow rate (discharge pressure) varies between the two chambers.

In addition, the conventional structure described above harbors the problem that the body must be segmented into a multiplicity of parts or the volume of the body increases to such an extent as to make a bulky injector.

SUMMARY OF THE INVENTION

The present invention has been developed in view of the aforementioned points, and the object thereof is to provide an injector having a simple, compact structure in which the pressure change in the chambers is relaxed at the time of reciprocating motion of the pressure application mechanism thereby to lengthen the service life of the component parts including the diaphragm portion, and a stable discharge flow rate with a small pulsation is obtained while at the same time securing the same discharge flow rate free of the variations.

According to a first aspect of the invention, there is provided an injector (I) comprising a body (B) including therein:

- a first outer inlet portion (13) for a fluid to be sent under pressure (F);
- a first outer outlet portion (14) for the fluid sent under pressure;
- a connecting inlet portion (21) communicating with the first outer inlet portion;
- a connecting outlet portion (22) communicating with the first outer connecting outlet portion;
- a second outer inlet portion (31) communicating with the connecting inlet portion;
- a second outer outlet portion (32) communicating with the connecting outlet portion;
- a first chamber (40) including a first intake portion (41) communicating with the first outer inlet portion and a first discharge portion (42) communicating with the first outer outlet portion;
- a second chamber (50) including a second intake portion (51) communicating with the second outer inlet portion and a second discharge portion (52) communicating with the second outer outlet portion;
- a first intake check valve (61) interposed between the first outer inlet portion and the first intake portion for causing the pressured fluid to flow toward the first intake portion;

a first discharge check valve (66) interposed between the first discharge portion and the first outer outlet portion for causing the pressured fluid to flow toward the first outer outlet portion;

a second intake check value (71) interposed between the second outer inlet portion and the second intake portion for causing the pressured fluid to flow toward the second intake portion;

a second discharge check valve (76) interposed between the second discharge portion and the second outer outlet portion for causing the pressured fluid to flow toward the second outer outlet portion;

a pressure application mechanism (80) including a first pressure application diaphragm portion (81) with the outer peripheral portion thereof fixed on the inner wall **(40*a*) of the first chamber and a second pressure application diaphragm portion (82) with the outer peripheral portion thereof fixed on the inner wall (50*a*) of the second chamber, the first pressure application diaphragm portion (81) and the second pressure application diaphragm portion (82) being arranged to be integrally movably by a coupling (83)**;

a working fluid influx/outlet portion (90) open to at least one of the first chamber and the second chamber for causing a working fluid (A) for reciprocating the pressure application mechanism to flow into or flow from at least one of the first chamber and the second chamber;

a first urging diaphragm portion (100) arranged on the outer wall surface **(40*b*)** of the inner wall of the first chamber for pressing the first pressure application diaphragm portion toward the second pressure application diaphragm portion when coming into contact with the outer surface of the first pressure application diaphragm portion;

first urging means for keeping the first urging diaphragm portion urged toward the second pressure application diaphragm portion;

a second urging diaphragm portion (120) arranged on the outer wall surface **(50*b*)** of the inner wall of the second chamber for pressing the second pressure application diaphragm portion toward the first pressure application diaphragm portion when coming into contact with the outer surface of the second pressure application diaphragm portion; and second urging means for keeping the second urging diaphragm portion urged toward the first pressure application diaphragm portion.

According to a second aspect of the invention, there is provided an injector of the first aspect, wherein the first urging means includes a first piston portion (110) arranged in a first receiving space (105) outside of the first urging diaphragm to be reciprocated in contact with the first urging diaphragm portion, and a first spring (115) for keeping the first piston portion urged toward the second pressure application diaphragm portion, and wherein the second urging means includes a second piston portion (130) arranged in a second receiving space (125) outside of the second urging diaphragm portion to be reciprocated in contact with the second urging diaphragm portion, and a second spring (135) for keeping the second piston portion urged toward the first pressure application diaphragm portion.

According to a third aspect of the invention, there is provided an injector of the first aspect, wherein the supply and discharge of the working fluid for reciprocating the pressure application mechanism to and from the first chamber or the second chamber is switched for a predetermined switching period by an external switching means, which switching period can be arbitrarily changed.

According to a fourth aspect of the invention, there is provided an injector of the first aspect, wherein the center position of the pressure application mechanism is rendered to coincide with the intermediate position of the longest reciprocation range of the pressure application mechanism, or the neighborhood thereof, by the cooperation between the first urging means and the second urging means at the time of stopping the supply or discharge of the fluid.

According to a fifth aspect of the invention, there is provided an injector of the first aspect, further comprising a first inlet (11) communicating with the first outer inlet portion, a first outlet (12) communicating with the first outer outlet portion, a second inlet (33) communicating with the second outer inlet portion, and a second outlet (34) communicating with the second outer outlet portion, wherein one of the first inlet and the second inlet is closed and one of the first outlet and the second outlet is closed while the injector is in operation.

According to a sixth aspect of the invention, there is provided an injector of the first aspect, wherein the body has built therein a first intake check valve block (60) including the first outer inlet portion and the first intake check valve, a first discharge check valve block (65) including the first outer outlet portion and the first discharge check valve, a second intake check valve block (70) including the second outer inlet portion and the second intake check valve, and a second discharge check valve block (75) including the second outer outlet portion and the second discharge check valve.

According to a seventh aspect of the invention, there is provided an injector of the first aspect, wherein the working fluid for reciprocating the pressure application mechanism flows into and from only one of the first chamber and the second chamber, the injector further comprising a spring (140) interposed between the inner wall of the chamber which no working fluid flows into or from and the inner surface of the pressure application diaphragm portion arranged in the particular chamber.

According to an eighth aspect of the invention, there is provided an injector of the first aspect, further comprising a first lid portion (116) for closing from the outside the first receiving space formed outside of the first urging diaphragm portion to receive the first urging means and a second lid portion (136) for closing from outside the second receiving space formed outside of the second urging diaphragm portion to receive the second urging means, the first lid portion (116) and the second lid portion (136) being formed of a transparent or translucent material.

According to a ninth aspect of the invention, there is provided an injector of the first aspect, comprising a first inlet communicating with the first outer inlet portion, a first outlet communicating with the first outer outlet portion, a second inlet communicating with the second outer inlet portion, a second outlet caricating with the second outer outlet portion, and working fluid intrusion detection means (210) for detecting the intrusion of the working fluid into the fluid flowing out from the first outlet or the second outlet.

According to a tenth aspect of the invention, there is provided an injector of the ninth aspect, further comprising inflowing fluid properties detection means (211) for detecting the properties of the fluid flowing in from the first inlet or the second inlet.

According to an 11th aspect of the invention, there is provided an injector of the second aspect, wherein the body is formed with a first vent hole (106) for discharging outside of the body the air between the first urging diaphragm portion and the first piston portion and a second vent hole (126) for discharging outside of the body the air between the second urging diaphragm portion and the second piston portion, the injector further comprising leakage detection means (230, 231) for detecting the presence or absence of the pressured fluid leaking from the first vent hole or the second vent hole.

BRIEF DESCRIPTION OF THE DRAWINGS

FIG. 7A is embodiment 1, which is a case of having an urging mechanism and the working fluid being supplied/discharged by external switching means, and a continuous line shows normal operation and operation restart.

FIG. 7B is reference 1, which is a case of having no urging mechanism and the working fluid being supplied/discharged by external switching means,and a continuous line shows normal operation and a broken line shows restart of operation (reciprocation center displaced).

FIG. 7C shows embodiment 2, which is a case of having an urging mechanism and the working fluid being supplied/discharged by mechanical means, and a continuous line shows normal operation and operation restart, FIG. 7D shows reference 2, which is a case of having no urging mechanism and the working fluid is supplied/discharged by mechanical means, and a continuous line shows normal operation and a broken line shows restart of operation (reciprocation center displaced).

FIG. 10A is a case of pressure regulated by adjust valve using injector of embodiment 1.

FIG. 10B is a case of pressure not regulated by adjust valve using injector of embodiment 1.

FIG. 10C is a case of pressure not regulated by adjust valve using conventional injector.

FIG. 10D is a case of pressure regulated by adjust valve using conventional injector.

DESCRIPTION OF THE PREFERRED EMBODIMENTS

The present invention will be described in detail below with reference to the accompanying drawings.

Figure 1:
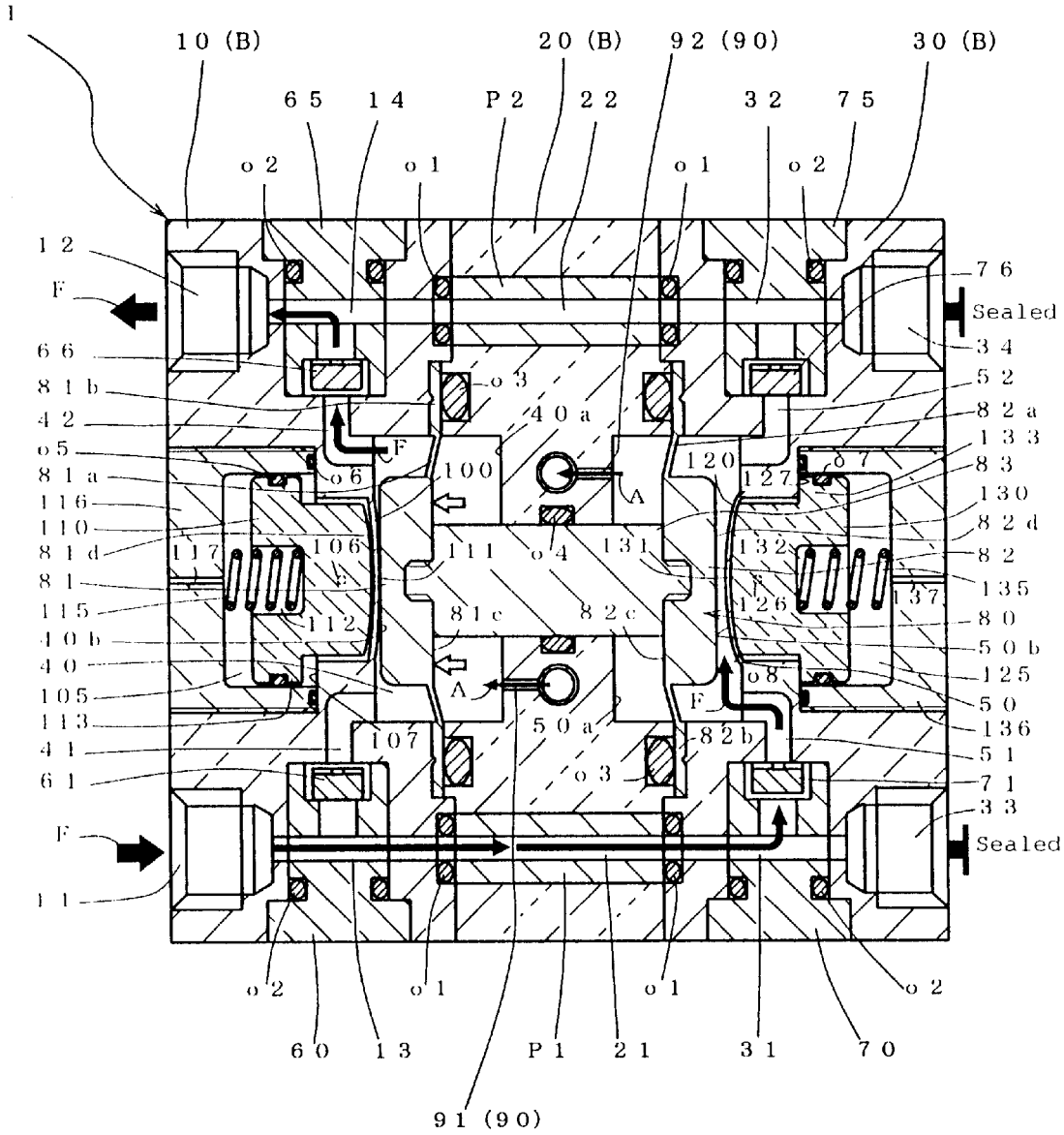
FIG. 1 is a longitudinal sectional view showing the manner in which the fluid is discharged from the first chamber in the case where the second inlet and the second outlet of the injector according to a first embodiment of the invention are closed.
Figure 2:
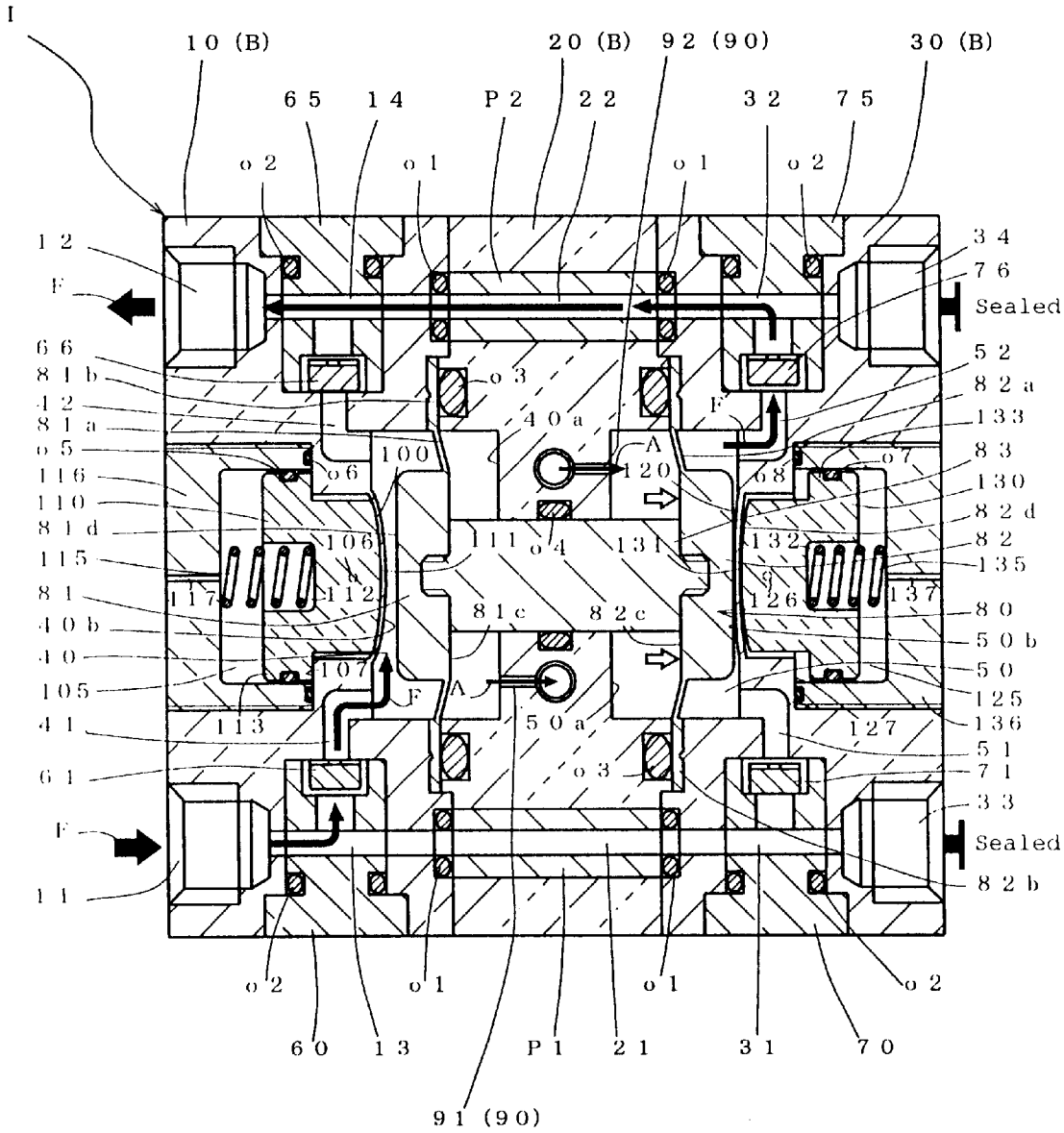
FIG. 2 is a longitudinal sectional view showing the manner in which the fluid is discharged from the second chamber of the same injector.
Figure 3:
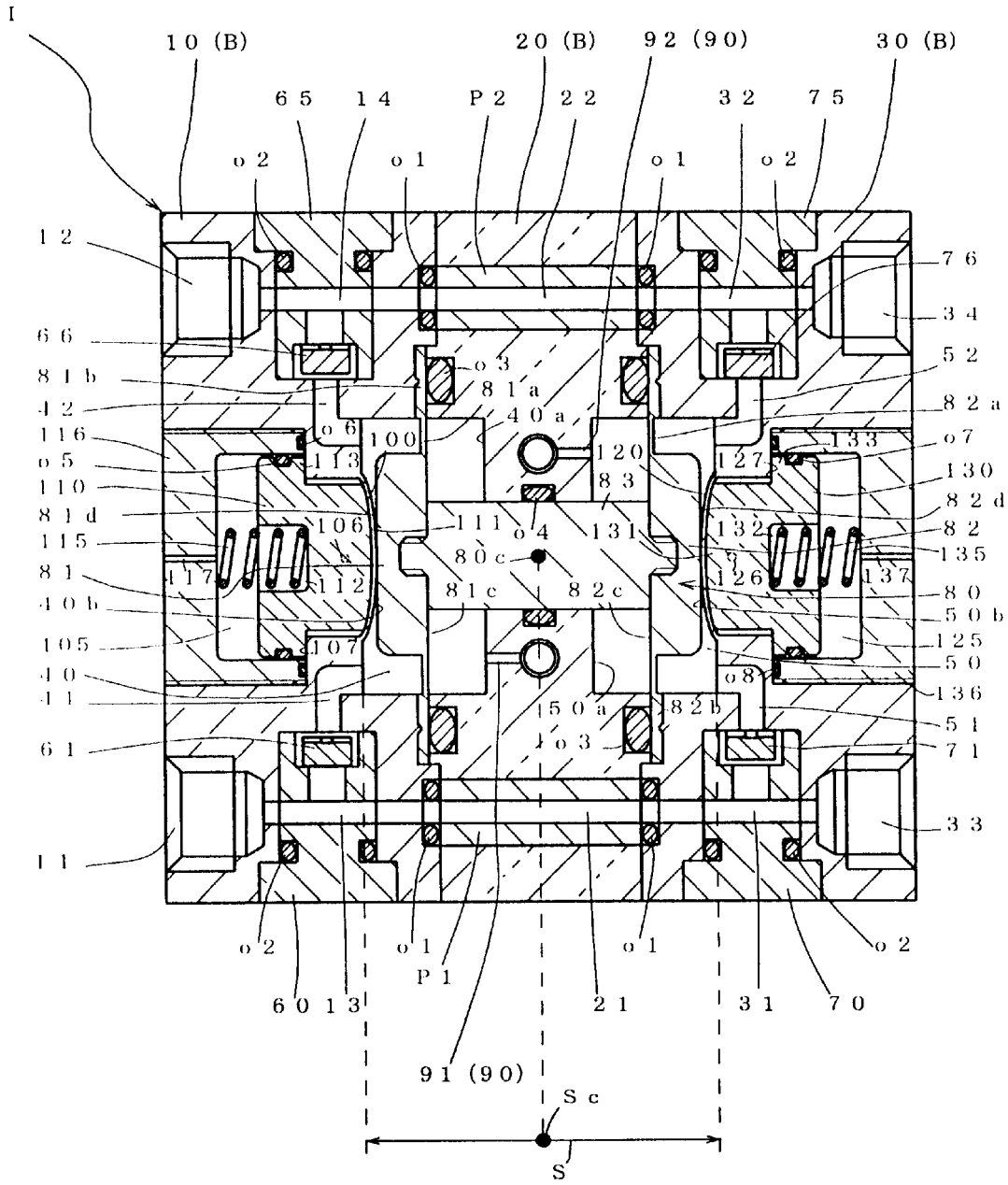
FIG. 3 is a longitudinal sectional view showing the manner in which the operation of the same injector is stopped.
Figure 4:
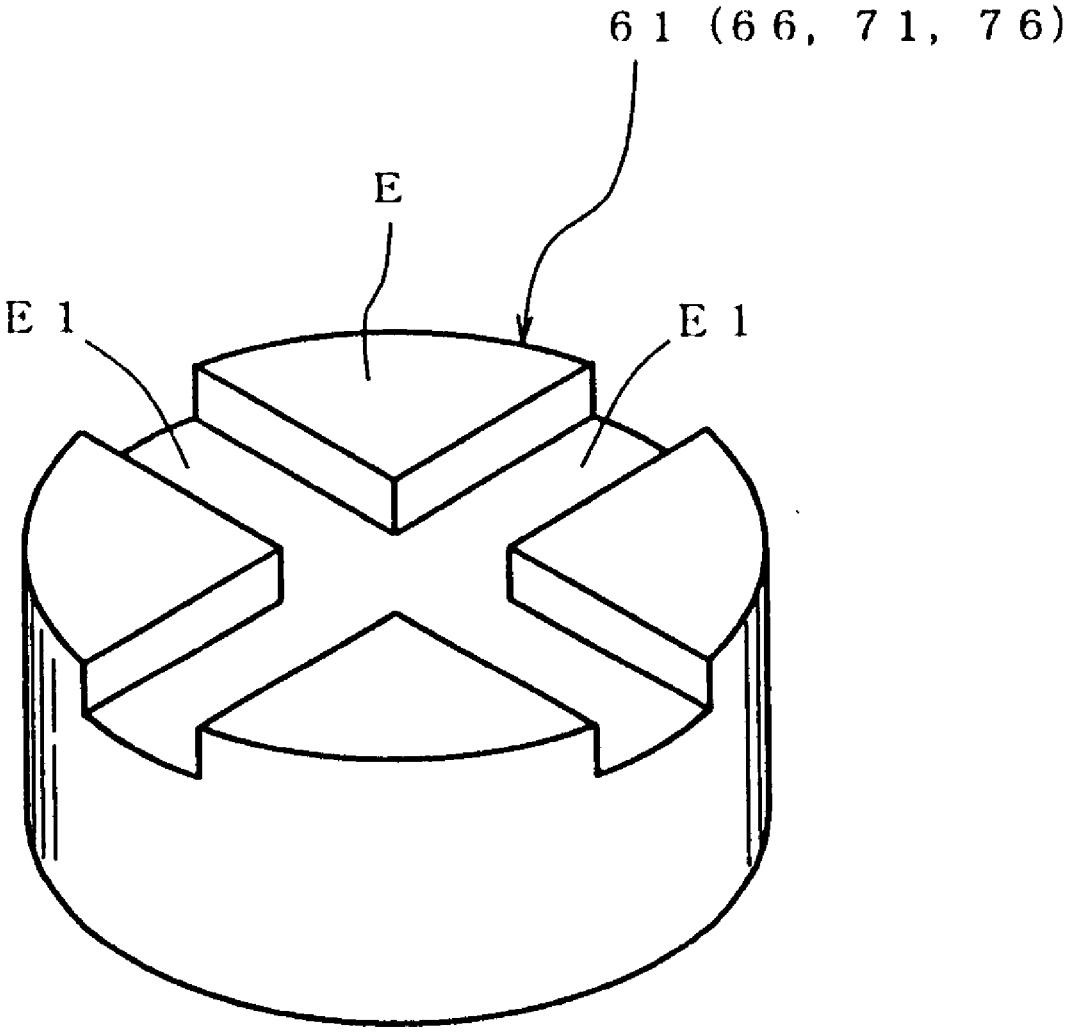
FIG. 4 is a perspective view showing a check valve used with the injector according to the same embodiment.
Figure 5:
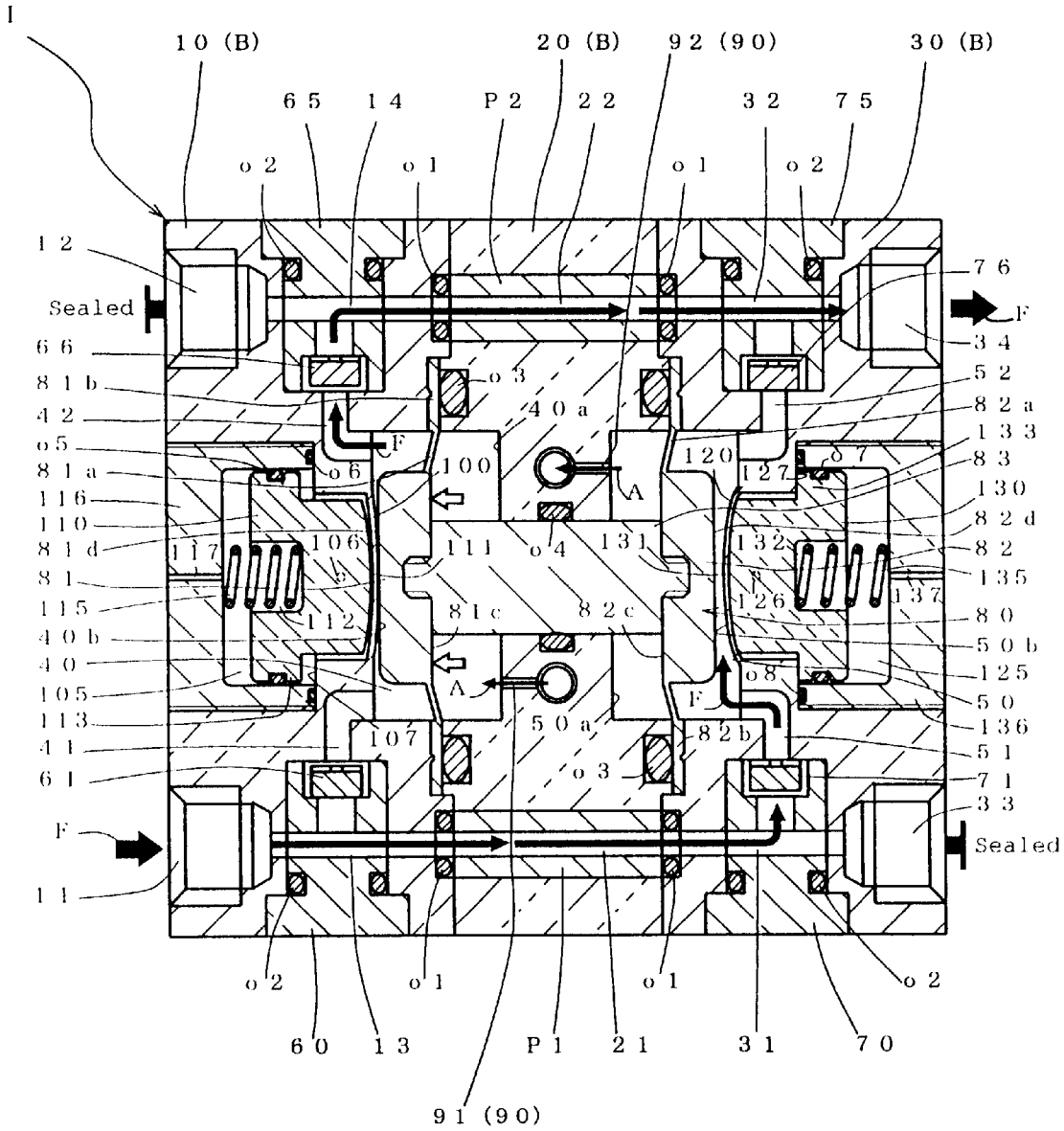
FIG. 5 is a longitudinal sectional view showing the manner in which the fluid is discharged from the first chamber in the case where the second inlet and the first outlet of the injector according to the same embodiment are closed.
Figure 6:
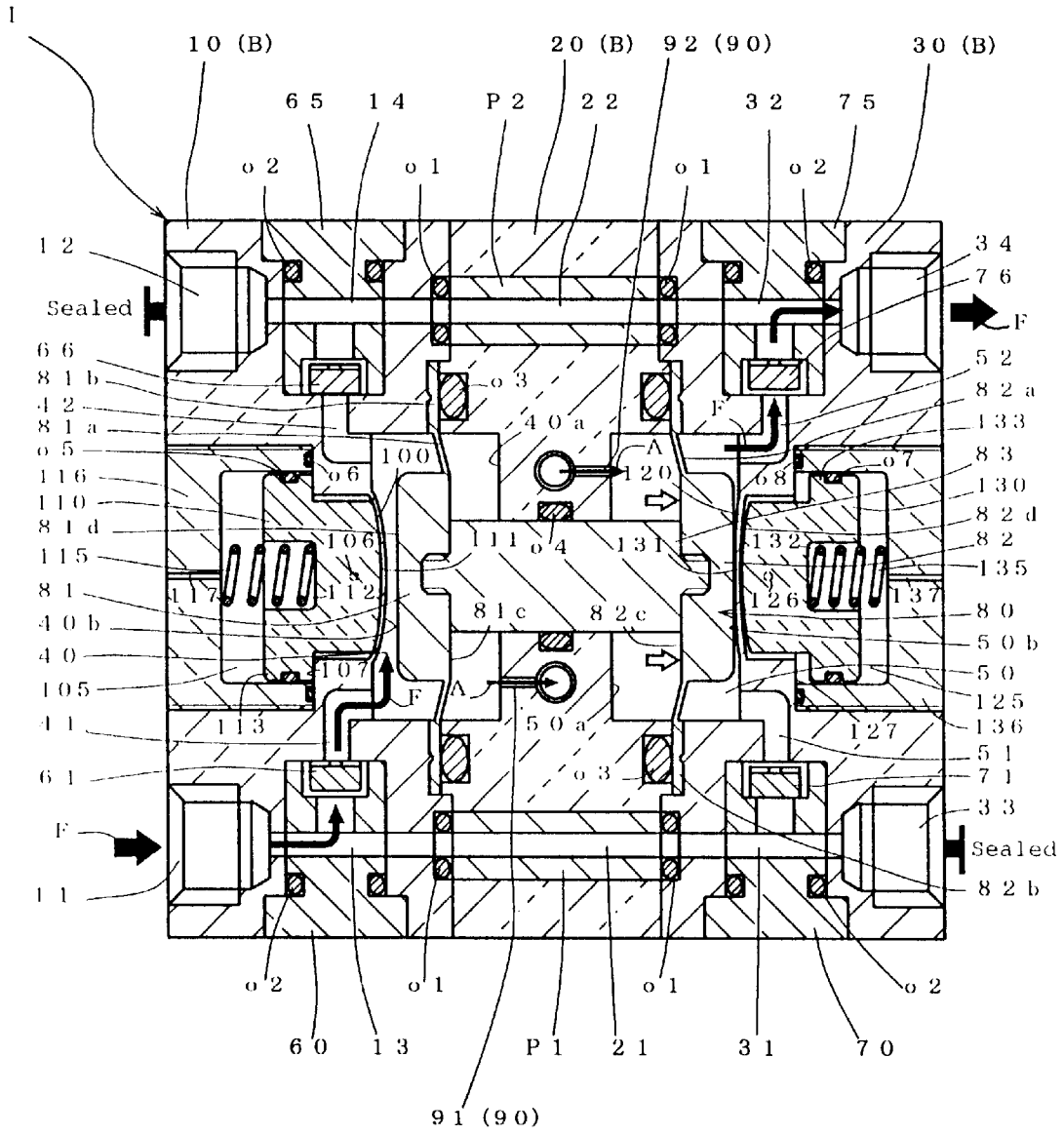
FIG. 6 is a longitudinal sectional view showing the manner in which the fluid is discharged from the second chamber of the injector according to the same embodiment.
Figure 7A:
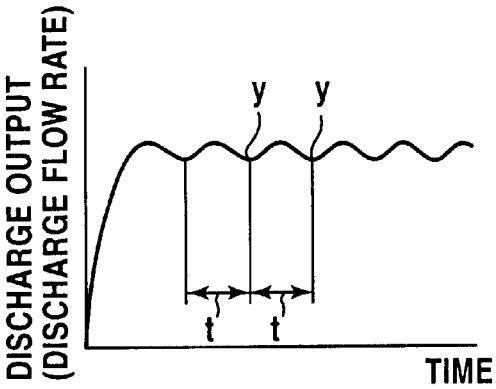
FIGS. 7A to 7D are graphs for explaining the effect of the injector according to the invention.
Figure 7B:
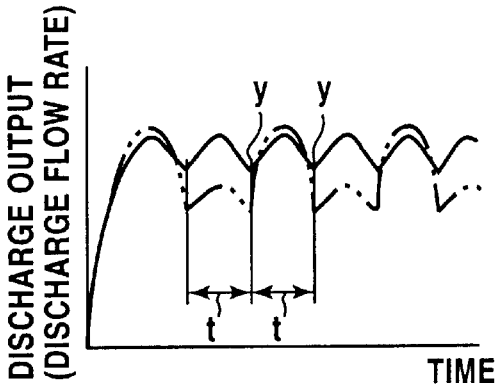
Figure 7C:
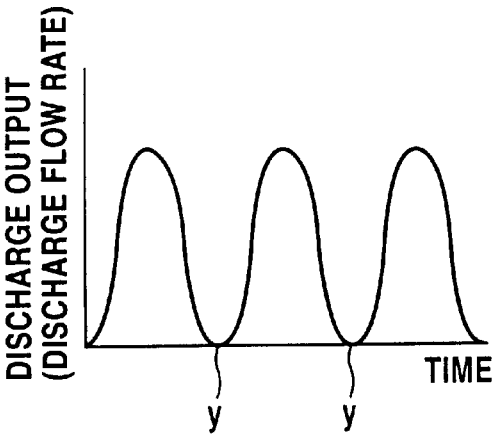
Figure 7D:
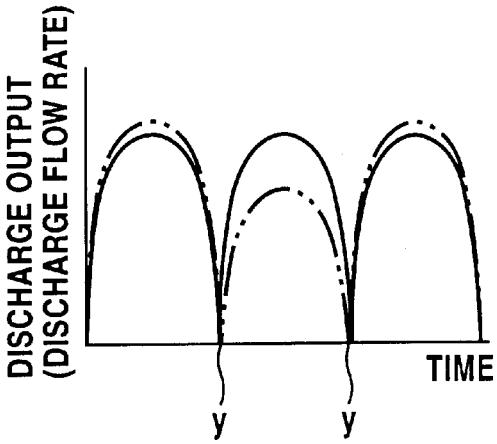
Figure 8:
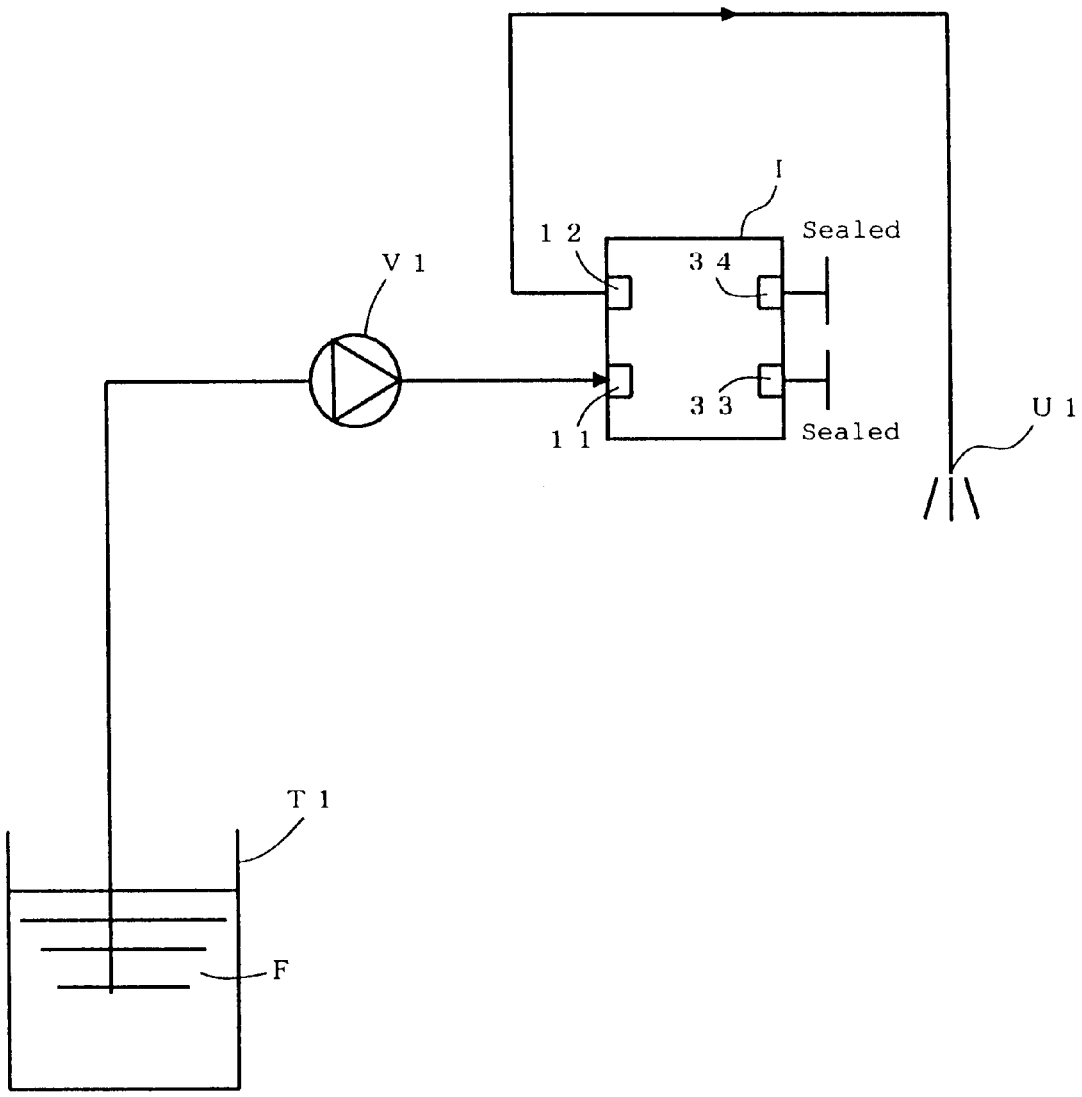
FIG. 8 is a schematic diagram showing an example of application of the injector according to the invention.
Figure 9:
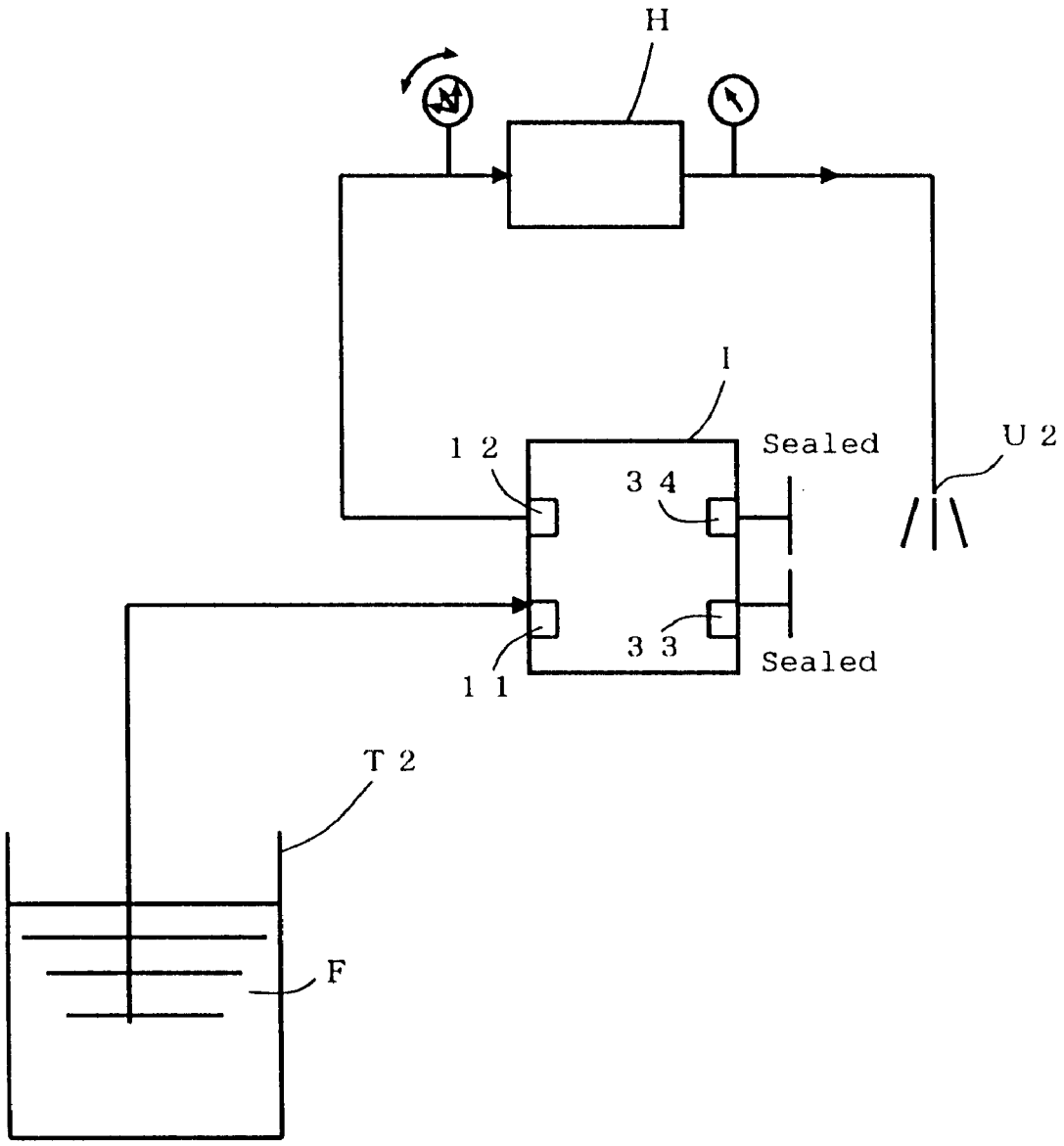
FIG. 9 is a schematic diagram showing another example of application of the injector according to the invention.
Figure 10A:
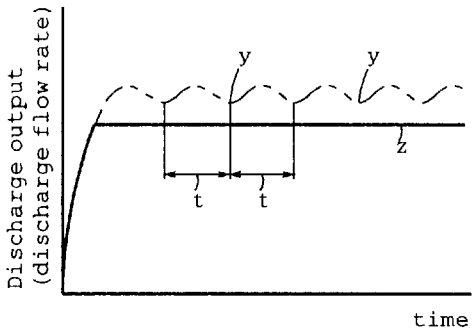
FIGS. 10A to 10D are graphs for explaining the effect of the application shown in FIG. 9.
Figure 10B:
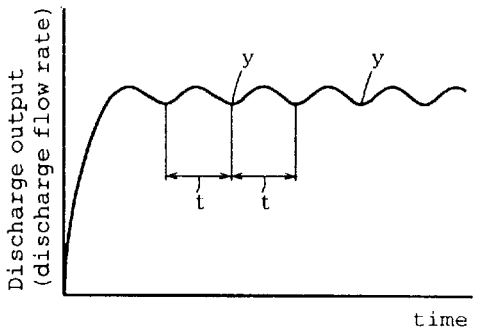
Figure 10C:
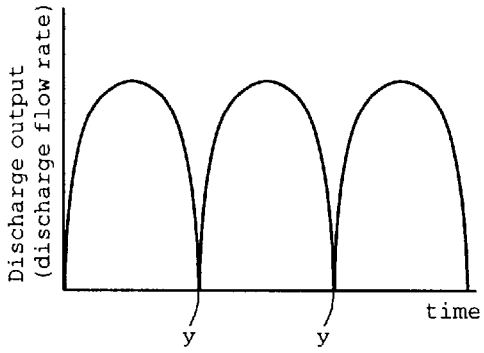
Figure 10D:
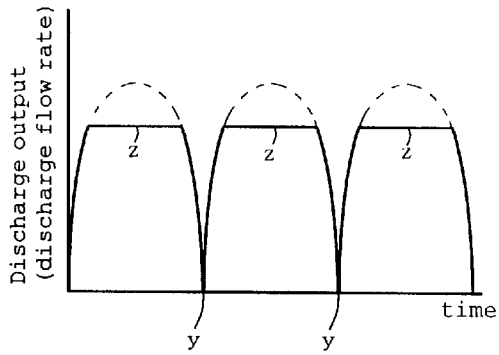
Figure 11:
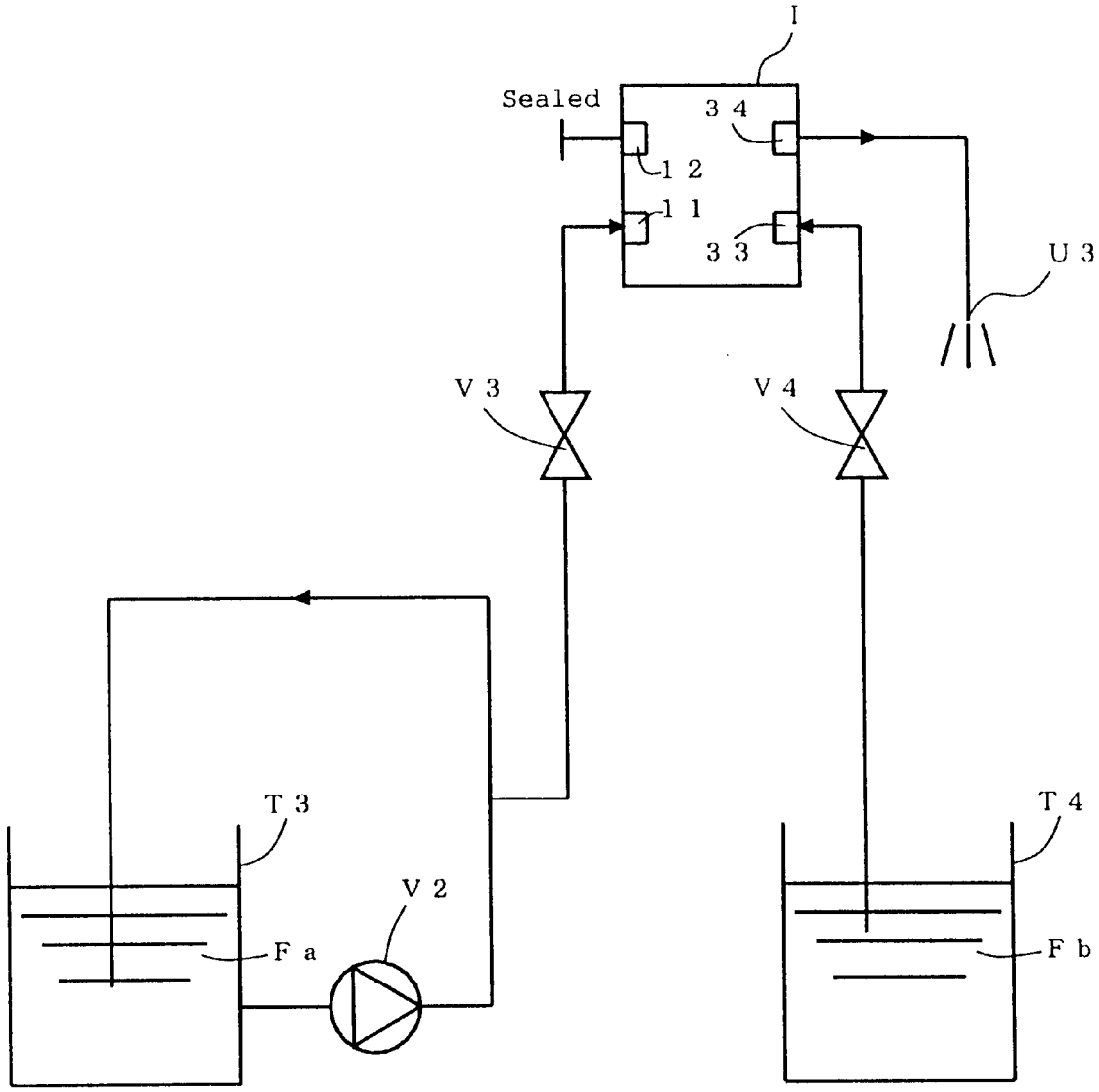
FIG. 11 is a schematic diagram showing still another example of application of the injector according to the invention.
Figure 12:
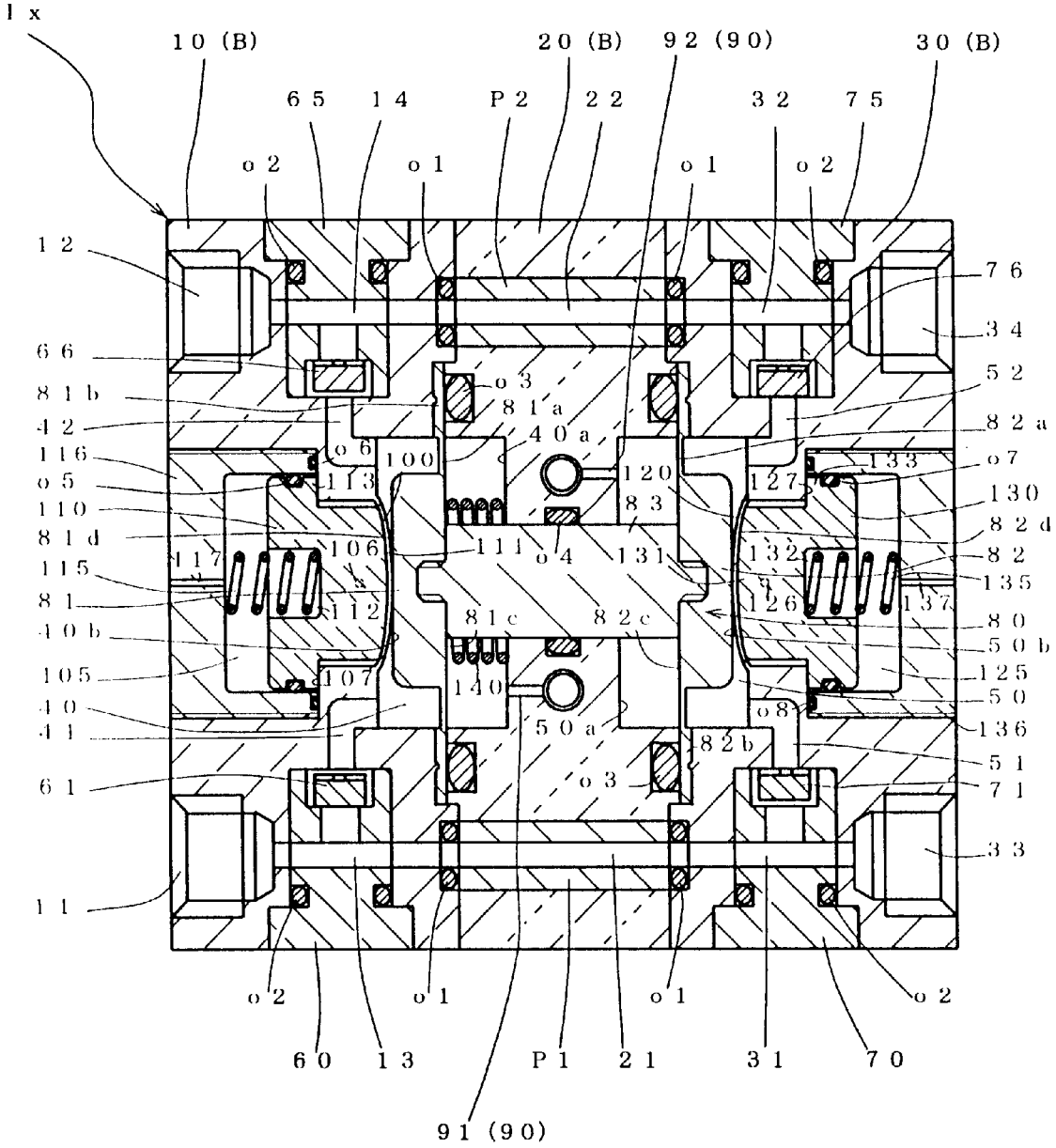
FIG. 12 is a longitudinal sectional view showing an injector according to another embodiment of the invention.
Figure 13:
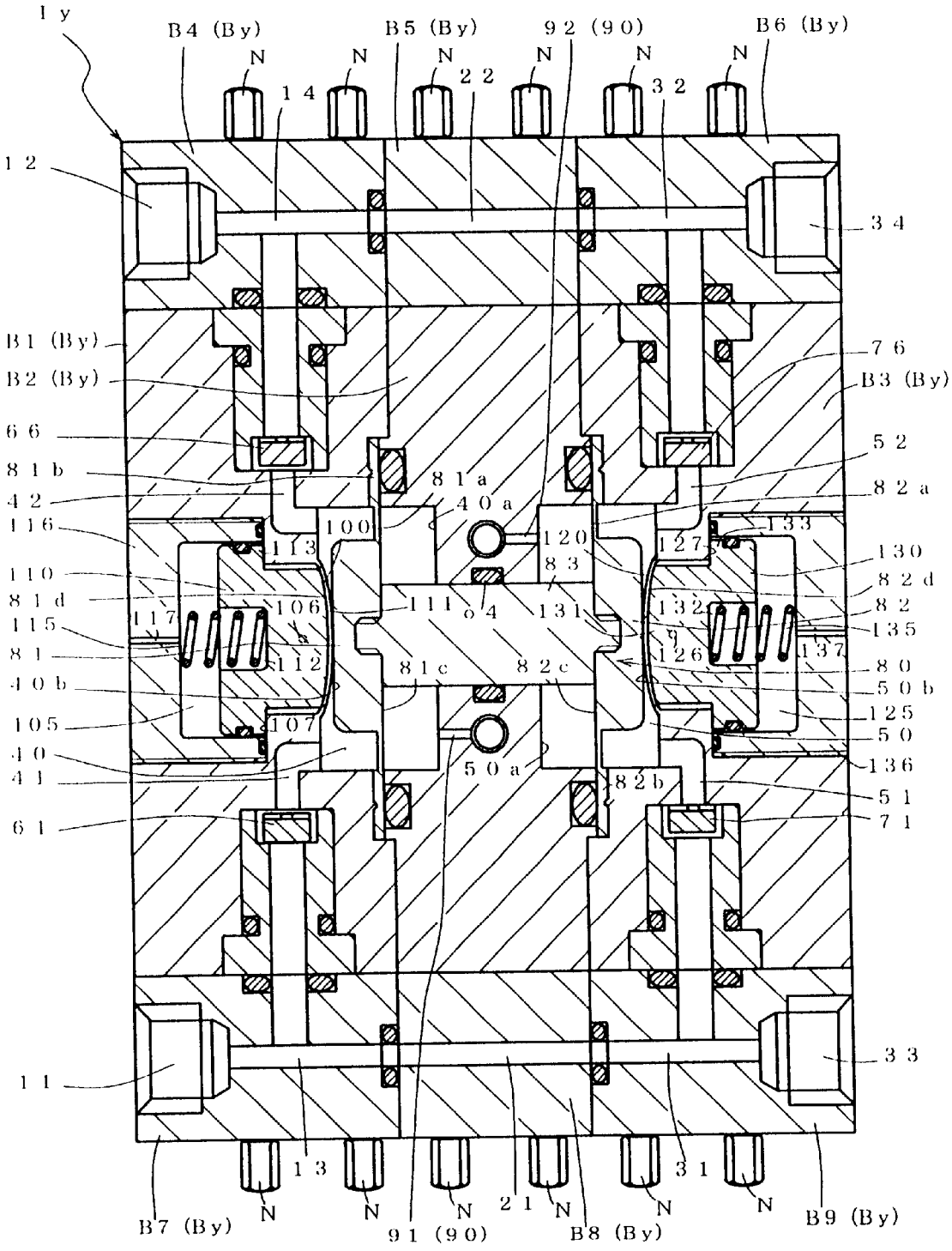
FIG. 13 is a longitudinal sectional view showing an injector according to still another embodiment of the invention.
Figure 14:
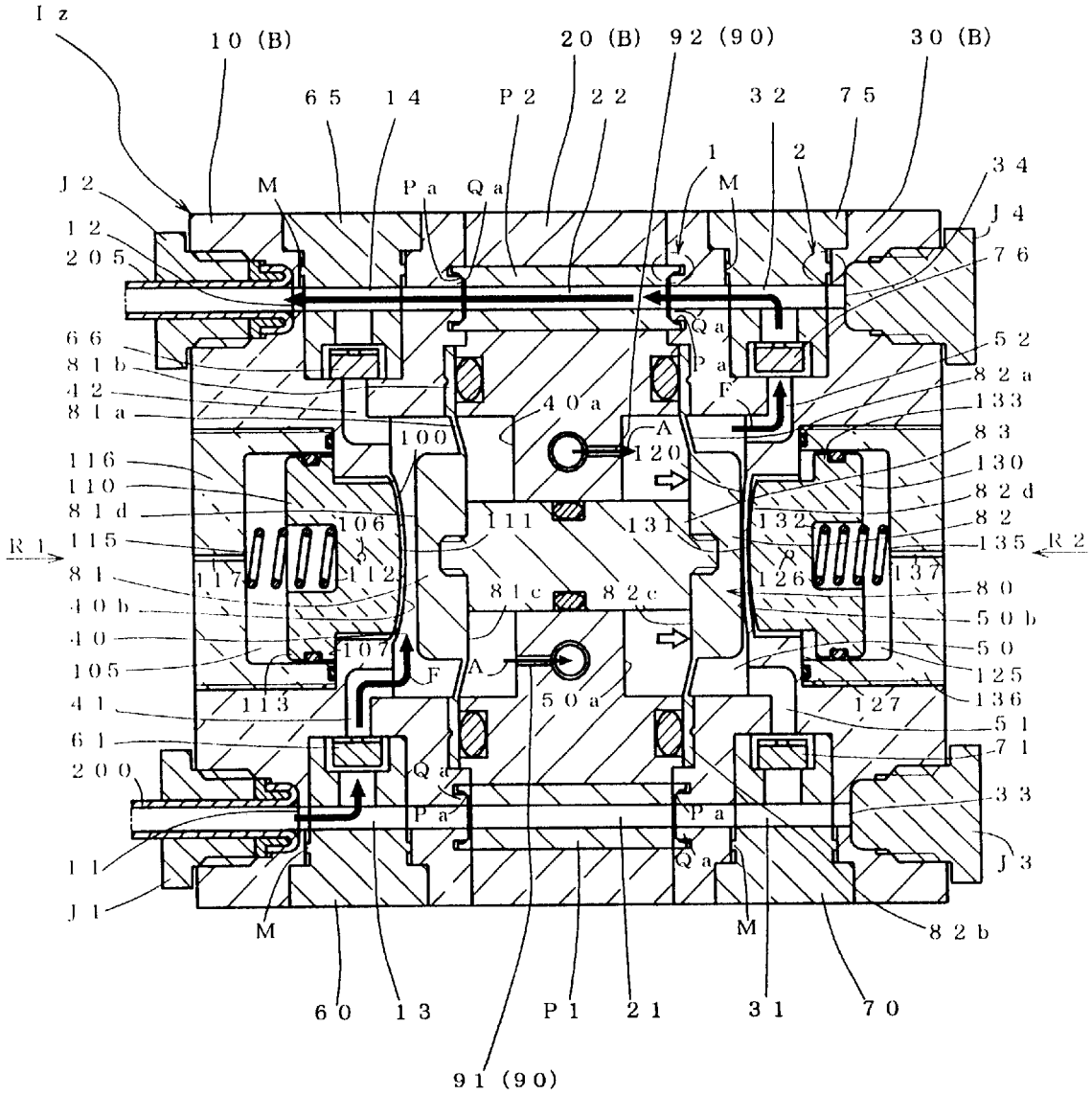
FIG. 14 is a longitudinal sectional view showing an injector according to yet another embodiment of the invention.
Figure 15:
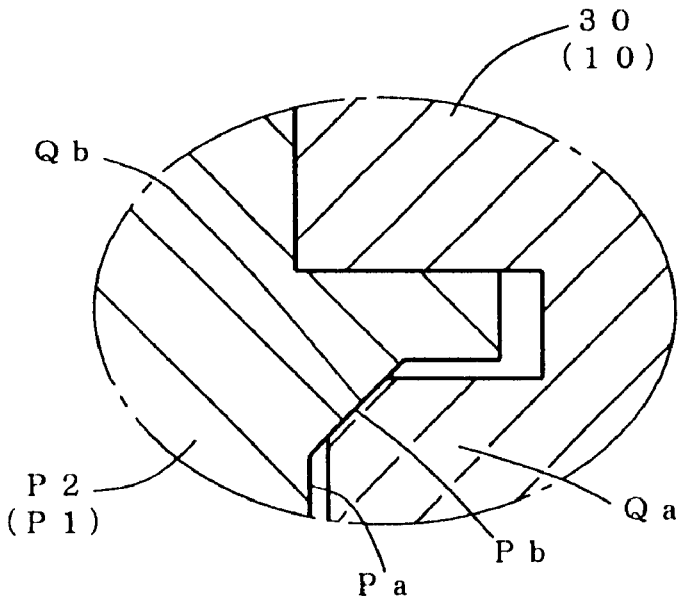
FIG. 15 is an enlarged sectional view showing the portions designated by numerals 1 and 2 in FIG. 14 in enlarged form.
Figure 15:
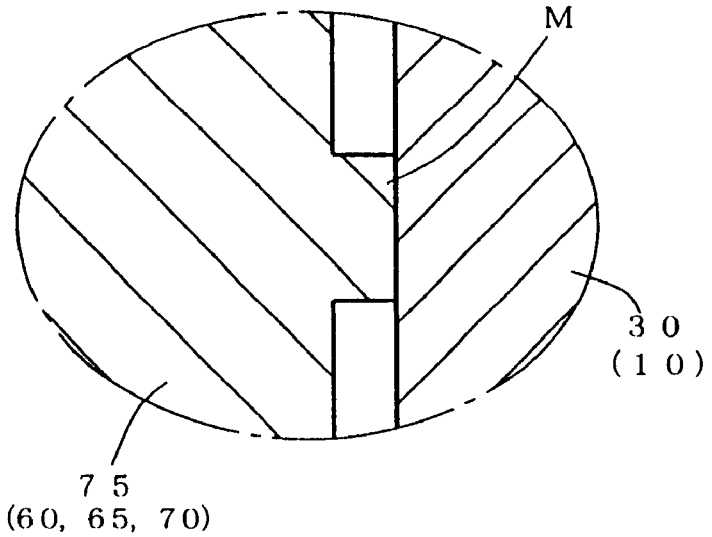
Figure 16:
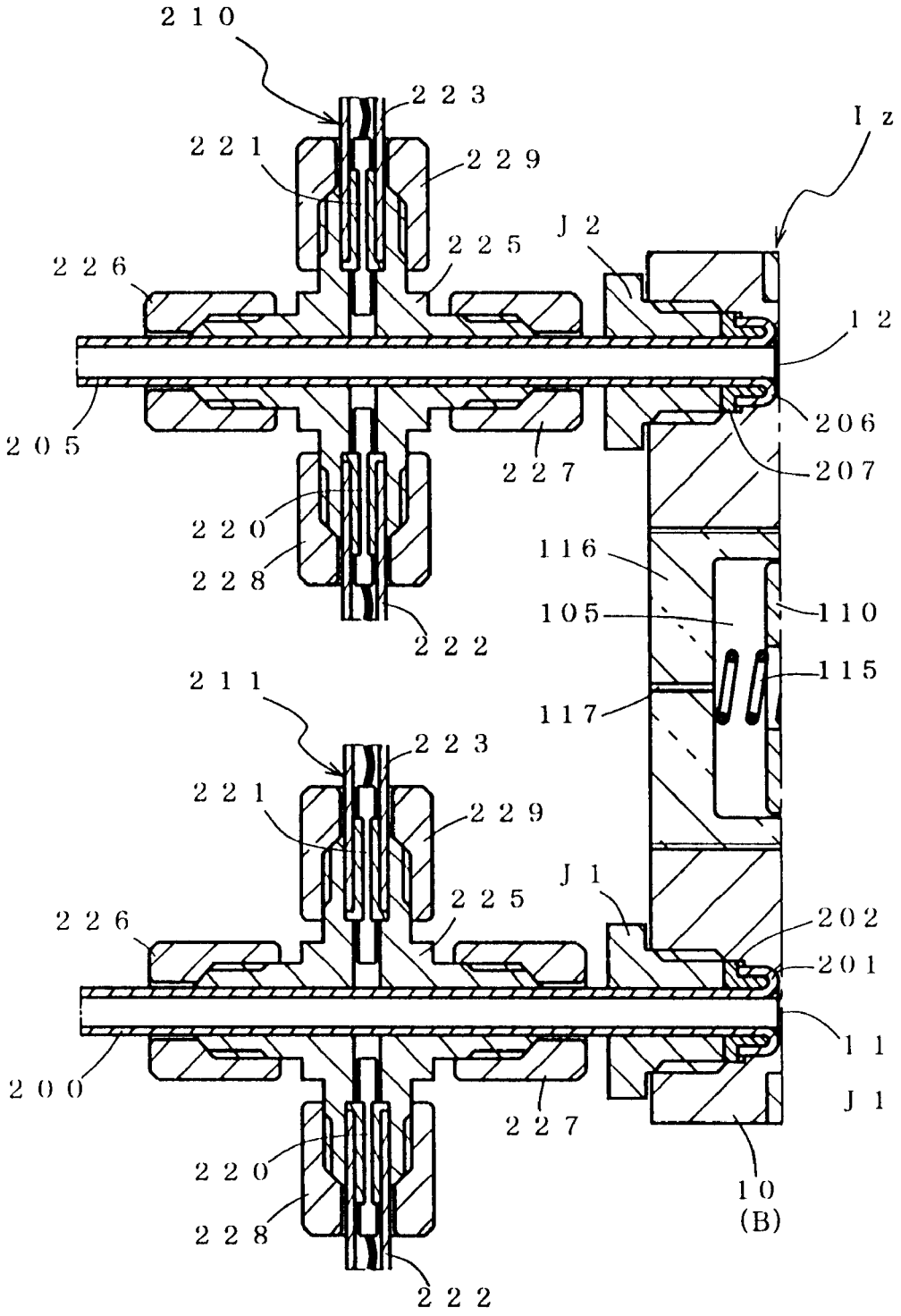
FIG. 16 is a sectional view showing the neighborhood of the working fluid intrusion detection means and the influent fluid properties detection means of the injector shown in FIG. 14.
Figure 17:
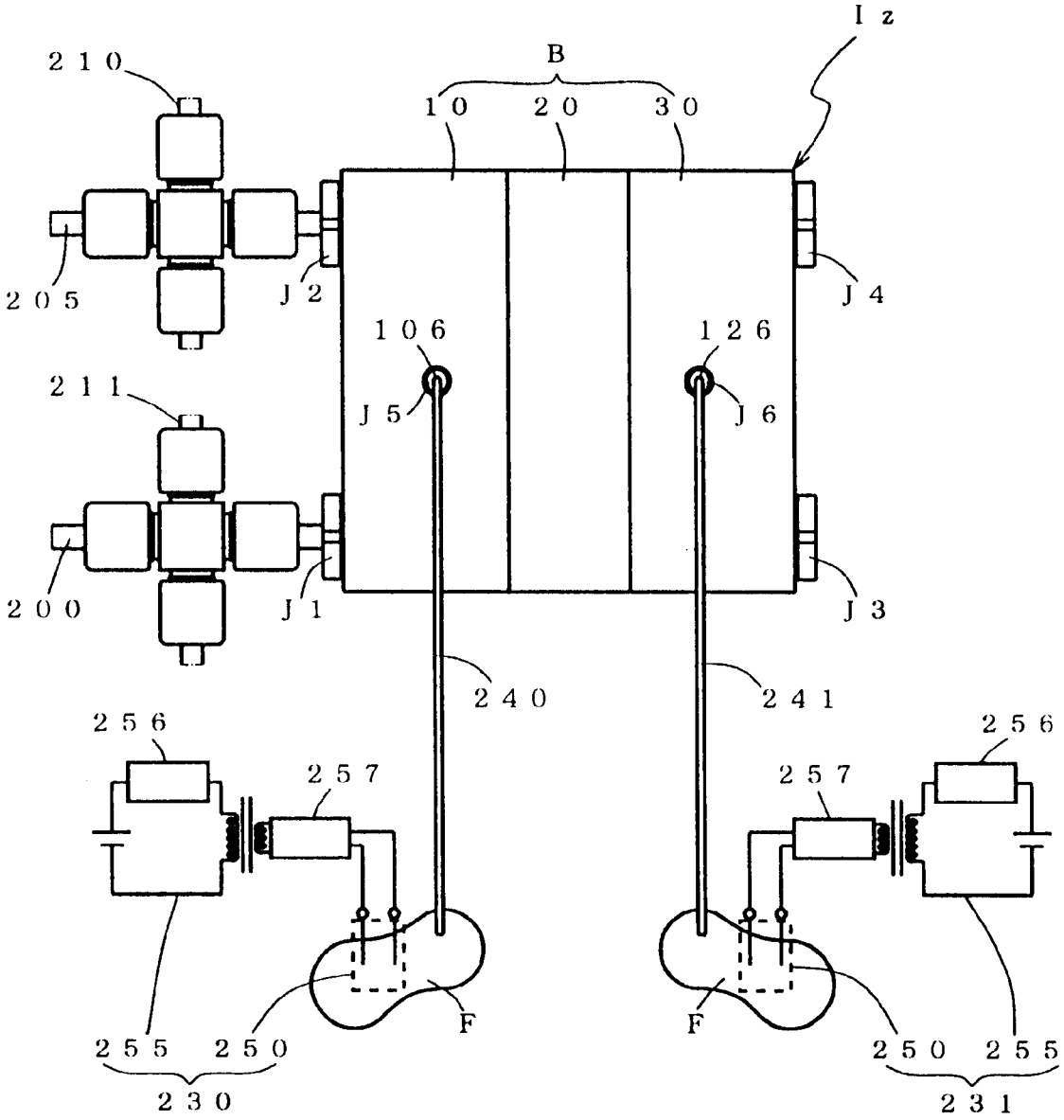
FIG. 17 is a schematic diagram showing the case in which the injector of FIG. 14 further comprises leakage detection means.

FIG. 1 is a longitudinal sectional view showing the manner in which the fluid is discharged from the first chamber in the case where the second inlet and the second outlet of the injector according to a first embodiment of the invention are closed; FIG. 2 is a longitudinal sectional view showing the manner in which the fluid is discharged from the second chamber of the same injector; FIG. 3 is a longitudinal sectional view showing the manner in which the operation of the same injector is stopped; FIG. 4 is a perspective view showing a check valve used with the injector according to the same embodiment; FIG. 5 is a longitudinal sectional view showing the manner in which the fluid is discharged from the first chamber in the case where the second inlet and the first outlet of the injector according to the same embodiment are closed; FIG. 6 is a longitudinal sectional view showing the manner in which the fluid is discharged from the second chamber of the injector according to the same embodiment; FIGS. 7A to 7D are graphs for explaining the effect of the injector according to the invention, FIG. 7A is embodiment 1, which is a case of having an urging mechanism and the working fluid being supplied/discharged by external switching means, and a continuous line shows normal operation and operation restart, FIG. 7B is reference 1, which is a case of having no urging mechanism and the working fluid being supplied/discharged by external switching means, and a continuous line shows normal operation and a broken line shows restart of operation (reciprocation center displaced), FIG. 7C shows embodiment 2, which is a case of having an urging mechanism and the working fluid being supplied/discharged by mechanical means, and a continuous line shows normal operation and operation restart, FIG. 7D shows reference 2, which is a case of having no urging mechanism and the working fluid is supplied/discharged by mechanical means, and a continuous line shows normal operation and a broken line shows restart of operation (reciprocation center displaced); FIG. 8 is a schematic diagram showing an example of application of the injector according to the invention; FIG. 9 is a schematic diagram showing another example of application of the injector according to the invention; FIGS. 10A to 10D are graphs for explaining the effect of the application shown in FIG. 9, FIG. 10A is a case of pressure regulated by adjust valve using injector of embodiment 1, FIG. 10B is a case of pressure not regulated by adjust valve using injector of embodiment 1, FIG. 10C is a case of pressure not regulated by adjust valve using conventional injector, FIG. 10D is a case of pressure regulated by adjust valve using conventional injector; FIG. 11 is a schematic diagram showing still another example of application of the injector according to the invention; FIG. 12 is a longitudinal sectional view showing an injector according to another embodiment of the invention; FIG. 13 is a longitudinal sectional view showing an injector according to still another embodiment of the invention; FIG. 14 is a longitudinal sectional view showing an injector according to yet another embodiment of the invention; FIG. 15 is an enlarged sectional view showing the portions designated by numerals 1 and 2 in FIG. 14 in enlarged form; FIG. 16 is a sectional view showing the neighborhood of the working fluid intrusion detection means and the influent fluid properties detection means of the injector shown in FIG. 14; and FIG. 17 is a schematic diagram showing the case in which the injector of FIG. 14 further comprises leakage detection means.

The injector shown in FIGS. 1 to 3 according to an embodiment of the invention has a body B having built therein a first outer inlet portion 13, a first outer outlet portion 14, a connecting inlet portion 21, a connecting outlet portion 22, a second outer inlet portion 31, a second outer outlet portion 32, a first chamber 40, a second chamber 50, a first intake check valve 61, a first discharge check valve 66, a second intake check valve 71, a second discharge check valve 76, a pressure application mechanism 80, a working fluid influx/outlet portion 90, a first urging diaphragm portion 100, first urging means 110, 115, a second urging diaphragm portion 120, and second urging means 130, 135. The body B according to this embodiment is configured of an integral assembly of a first outer block 10, an intermediate block 20 and a second outer block 30 integrally. Also, the injector I according to this embodiment is assembled on the various apparatuses on the semiconductor production line, etc. for supplying such fluids as chemicals and ultrapure water under pressure. Each part will be described in detail below.

The first outer block 10 has on one side thereof the first inlet 11 and the first outer inlet portion 13 communicating with the first inlet 11 for causing the pressured fluid F to flow into the body B, and has on the other side thereof the first outlet 12 and the first outer outlet portion 14 communicating with the first outlet 12 for causing the pressured fluid F to flow out of the body B. According to this embodiment, the first outer block 10 is formed of a resin such as a fluorine-containing resin having a high resistance to corrosion and chemicals.

The intermediate block 20 is arranged inside of the first outer block 10, and includes the connecting inlet portion 21 communicating with the first outer inlet portion 13 and the connecting outlet portion 22 communicating with the first outer outlet portion 14. According to this embodiment, the intermediate block 20 (except for the connecting inlet portion 21 and the connecting outlet portion 22) is formed of a transparent or translucent material such as transparent polyvinyl chloride resin making it possible to visually recognize, from the outside the operation of the pressure application mechanism described later. Further, according to this embodiment, the connecting inlet portion 21 and the connecting outlet portion 22 are formed of tubular members, P2 embedded in the intermediate block 20. Also, the tubular members, P2 are preferably formed of a resin such as a fluorine-containing resin having a high resistance to corrosion and chemicals taking the contact with the pressured fluid F into consideration. In the shown case, a seal member o1 such as an O-ring is interposed between each of the tubular members P1, P2 and the first outer block 10 for an improved sealability.

The second outer block 30, which is arranged on the outside of the intermediate block 20 far from the first outer block 10, includes on one side thereof the second outer inlet portion 31 communicating with the connecting inlet portion 21 of the intermediate block 20 and the second inlet 33 communicating with the second outer inlet portion 31 to allow the pressured fluid F to flow into the body B. The second outer block 30 includes on the other side thereof the second outer outlet portion 32 communicating with the connecting outlet portion 22 of the intermediate block 20 and the second outlet 34 communicating with the second outer outlet portion 32 to allow the pressured fluid F to flow out of the body B. According to this embodiment, the second outer block 30 is formed of such resin as a fluorine-containing resin having a high resistance to corrosion and chemicals. Further, in the illustrated case, a seal member o1 such as an O-ring is interposed between the second outer block 30 and each of the tubular members P1, P2 for an improved sealability.

The first outer block 10, the intermediate block 20 and the second outer block 30 making up the body B are assembled integrally by appropriate means. According to this embodiment, the whole body B having integrally assembled thereon the first outer block 10, the intermediate block 20 and the second outer block 30 has a rectangular profile, so that the injector I is arranged quite snugly in position.

The first chamber 40 is formed of the first outer block 10 and the intermediate block 20. The first chamber 40 includes a first intake portion 41 communicating with the first outer inlet portion 13 and a first discharge portion 42 communicating with the first outer outlet portion 14. A first intake check valve 61 is interposed between the first outer inlet portion 13 and the first intake portion 41 to allow the pressured fluid F to flow toward the first intake portion 41, and a first discharge check valve 66 is interposed between the first outer outlet portion 14 and the first discharge portion 42 to allow the pressured fluid to flow toward the first outer outlet portion 14.

The second chamber 50 is formed of the intermediate block 20 and the second outer block 30. The second chamber 50 includes a second intake portion 51 communicating with the second outer inlet portion 31 and a second discharge portion 52 communicating with the second outer outlet portion 32. The second intake check valve 71 configured to allow the pressure fluid F to flow toward the second intake portion 51 is inserted between the second outer inlet portion 31 and the second intake portion 51, and the second discharge check valve 76 configured to allow the pressured fluid to flow toward the second outer outlet portion 32 is interposed between the second outer outlet portion 32 and the second discharge portion 52.

According to this embodiment, like the invention defined in claim 6, the first intake check valve block 60 including the first outer inlet portion 13 and the first intake check valve 61, and the first discharge check valve block 65 including the first outer outlet portion 14 and the first discharge check valve 66 are assembled as independent members, respectively, in the first outer block 10 of the body B. At the same time, the second intake check valve block 70 including the second outer inlet portion 31 and the second intake check valve 71, and the second discharge check valve block 75 including the second outer outlet portion 32 and the second discharge check valve 76 are assembled as independent members, respectively, in the second outer block 30 of the body B. By doing so, the volume of the injector I as a whole can be reduced and a compact injector I can be realized.

According to this embodiment, the first outer inlet portion 13, the first outer outlet portion 14, the second outer inlet portion 31 and the second outer outlet portion 32 of the check valve blocks 60, 65, 70 and 75 are formed by being bent substantially at right angles. By doing so, the movable axes of the check valves 61, 66, 71, 76 and the open axes of the inlets 11, 13 and the outlets 12, 34 intersect at right angles with each other. Thus, direction in which the pressured fluid F flows can be changed, whenever necessary, within each of the check valves 60, 65, 70, 75, thereby making it possible to further reduce the volume of the injector I as a whole. Incidentally, the check valve blocks 60, 65, 70, 75 are formed of a resin such as a fluorine-containing resin having a high resistance to corrosion and chemicals. Reference numeral o2 designates a seal member such as an O-ring interposed between each of the check valve blocks 60, 65, 70, 75 on the one hand and the first outer block 10, the intermediate block 20 and the second outer block 30, on the other hand, respectively.

Further, according to this embodiment, the check valves 61, 66, 71, 76, as will be easily understood from FIG. 4, are each formed of a circular cylinder or a rectangular cylinder (the former in the shown case) having on one side end surface E formed with a plurality of fluid paths E1 radially. Nevertheless, the check valves are, of course, not limited to this configuration.

The pressure application mechanism 80 includes a first pressure application diaphragm 81 arranged in the first chamber 40 and a second pressure application diaphragm 82 arranged in the second chamber 50. The first pressure application diaphragm 81 and the second pressure application diaphragm 82 are coupled to each other integrally movably by a coupling 83 arranged through the intermediate block 20, and are arranged in the body B. The pressure application mechanism 80 according to this embodiment is coupled by being screwed with the portions 81, 82, 83. Nevertheless, the configuration is of course not limited to this example, but the first pressure application diaphragm 81 and the coupling 83 may be forced integrally with each other, and the second pressure application diaphragm 82 may be fixed by being screwed to the coupling 83, or the second pressure application diaphragm 82 and the coupling 83 may be integrally formed with each other and the first pressure application diaphragm 81 may be fixedly screwed to the coupling 83 with equal effect. Also, the pressure application mechanism 80, according to this embodiment and like the blocks described above, is formed of a resin such as a fluorine-containing resin having a high resistance to corrosion and chemicals.

The first pressure application diaphragm portion 81 has a thin movable portion 81*a* constituting a diaphragm surface and an outer peripheral portion 81*b* on the outer periphery of the movable portion 81*a*. The outer peripheral portion 81*b* is fixed on the inner wall 40*a* of the first chamber 40. Also, the second pressure application diaphragm portion 82 has a thin movable portion 82*a* making up a diaphragm surface and an outer peripheral portion 82*b* on the outer peripheral surface of the movable portion 82*a*. The outer peripheral portion 82*b* is fixed on the inner wall 50*a* of the second chamber 50. According to this embodiment, as shown, the outer peripheral portion 81*b* of the first pressure application diaphragm 81 is fixedly held between the first outer block 10 and the intermediate block 20. The outer peripheral portion 82*b* of the second pressure application diaphragm portion 82, on the other hand, is fixedly held between the intermediate block 20 and the second outer block 30. Reference numeral o3 designates seal members such as O-rings each interposed between each of the outer peripheral portions 81*b*, 82*b* of the pressure application diaphragm portions 81, 82 and the intermediate block 20, and numeral o4 a seal member such as an O-ring interposed between the coupling 83 and the intermediate block 20. Incidentally, the movable portions 81*a*, 82*a* of the pressure application diaphragm portions 81, 82 have a substantially linear section, to which the invention is not limited, but a corrugated section can be employed for the movable portions.

The working fluid influx/outlet portion 90 is formed in the intermediate block 20, and is opened to at least one of the first chamber 40 and the second chamber 50. This portion 90 functions in such a way that the working fluid for reciprocating the pressure application mechanism 80 such as a pressure adjusting gas A for increasing or decreasing the pressure exerted on the pressure application diaphragm 81, 82, for example, is caused to flow into or out of the space between the inner wall 40*a* or 50*a* of one of the two chambers 40, 50 and the inner surface 81*c* or 82*c* of the pressure application diaphragm 81 or 82 arranged in the chambers 40, 50. The working fluid influx/outlet portion 90 is connected with a working fluid supply unit such as a copressor external to the body B.

According to this embodiment, the working fluid influx/outlet portion 90 includes a first working fluid influx/outlet portion 91 open to the first chamber 40 from the intermediate block 20 for causing the working fluid A to flow into or out of the space between the inner wall 40*a* of the first chamber 40 and the inner surface 81*c* of the first pressure application diaphragm portion 81 and a second working fluid influx/outlet portion 92 open to the second chamber 50 from the intermediate block 20 for causing the working fluid A to flow into or out of the space between the inner wall 50*a* of the first chamber 50 and the inner surface 82*c* of the second pressure application diaphragm portion 82. The pressure application mechanism 80 is adapted to be reciprocated by supplying the working fluid A into the chambers 40, 50 alternately. While one of the chambers is supplied with the working fluid A through the first working fluid influx/outlet portion 91 or the second working fluid influx/outlet portion 92, the working fluid A that has thus far been filled in the particular chamber from the other chamber is discharged out of the injector I through the first working fluid influx/outlet portion 91 or the second working fluid influx/outlet portion 92.

According to this embodiment, the operation of supplying the working fluid A for reciprocating the pressure application mechanism 80 to the first chamber 40 or the second chamber 50 and the operation of discharging the working fluid A from each chamber can be switched, i.e. the supply side of the working fluid can be switched for a predetermined switching period by external switching means (not shown) as in the invention of claim 3, which switching period can be arbitrarily changed. The switching means is preferably a 4- or 5-way solenoid valve driven by an arbitrary periodic on-off signal from a sequencer or a timer or a switching solenoid valve making up a combination of two 3-way solenoid valves operating opposite to each other.

The switching period, if made changeable, for the operation of supplying and discharging the working fluid A as described above makes it possible to easily change the period of reciprocation and hence the reciprocation range of the pressure application mechanism 80. As a result, the switching period can be set to shorter than the time required for the diaphragm portions 81, 82 of the pressure application mechanism 80 to reach the stroke end thereof and to invert the pressure application mechanism 80 before the diaphragm portions 81, 82 thereof reach the stroke end. In such a case, as will be understood from the graphs of FIGS. 7A and 7B showing the relation between the discharge pressure of the pressured fluid and time, it is possible to reduce the pulsation of the discharge pressure of the pressured fluid F caused at the outlet 12 or 34 at the inversion time (switch timing) y of the pressure application mechanism 80. In other words, the fluid can be supplied with a lower pressure variation. The operation of supplying the working fluid A to the first chamber 40 or the second chamber 50 and the operation of discharging the working fluid A from the chambers can be switched not by the method described above, but at the time point when the stroke end of the pressure application mechanism 80 is detected by a stroke end detecting switch or sensor built in the body B, or by a mechanical method utilizing the increase in the internal pressure of the chamber 40 or 50 supplied with the working fluid A when it reaches the stroke end of the pressure application mechanism 80. In such a case, as will be understood from the graphs of FIGS. 7C and 7D, the discharge pressure at the time y of inversion of the pressure application mechanism 80 is reduced to zero. Character t in FIGS. 7A, 7B designates the period of supply and discharge of the working fluid A to and from the chambers.

The first urging diaphragm portion 100 is arranged as a thin movable portion on the outer wall surface 40*b* of the inner wall 40*a* of the first chamber. The first urging diaphragm portion 100 is deformed (expanded/compressed) by the reciprocating motion of the pressure application mechanism 80 and the action of the first urging means described later, and when it comes into contact with the outer surface 81d of the first pressure application diaphragm portion 81, adapted to press the first pressure application diaphragm portion 81 toward the second pressure application diaphragm portion. Incidentally, although the first urging diaphragm portion 100 according to this embodiment is formed integrally with the first outer block 10, the invention is not limited to this configuration but the first urging diaphragm portion may be fixed as an independent member on the inner wall 40*a* (first outer block 10) of the first chamber.

The first urging means 110, 115 are for urging the first urging diaphragm portion 100 constantly inward, i.e. toward the second pressure application diaphragm portion. In this embodiment, as in the invention of claim 2, the first urging means 110, 115 each include a first piston portion 110 arranged in such a manner as to reciprocate while in contact with the first urging diaphragm portion 100 in the first receiving space 105 on the outside of the first urging diaphragm portion 100 of the first outer block 10, and a first spring 115 for urging the first piston portion 110 constantly inward, i.e. toward the second pressure application diaphragm portion. Also, the first piston portion 110 according to this embodiment has the end surface 111 on the pressure side at the forward end thereof (inside) in contact with the first urging diaphragm portion 100. Numeral 106 in the diagram designates a first vent hole (respiration hole) for discharging the air between the first urging diaphragm portion 100 and the first piston portion 110 out of the body B. Numeral 112 designates a spring mounting opening formed in the first piston portion 110, numeral 116 a first lid portion (first spring receiving portion) for receiving the first spring 115 by closing the opening of the first receiving space 105, numeral 117 a first discharge hole formed in the first lid portion 116 for discharging outside the air between the first lid portion 116 and the first piston portion 111, numeral o5 a seal member such as an O-ring interposed between the first piston portion 110 and the first lid portion 116, and numeral o6 a seal member such as an O-ring interposed between the first outer block 10 and the first lid portion 116.

The second urging diaphragm portion 120 is arranged as a thin movable portion on the outer wall surface 50*b* of the inner wall 50*a* of the second chamber. The second urging diaphragm portion 120 is deformed (expanded/compressed) by the reciprocating motion of the pressure application mechanism 80 and the action of the second urging means described later, and is adapted to press the second pressure application diaphragm portion 82 toward the first pressure application diaphragm portion when it comes into contact with the outer surface 82*d* of the second pressure application diaphragm portion 82. Incidentally, although the second urging diaphragm portion 120 according to this embodiment is formed integrally on the second outer block 30, the invention is not limited to such a configuration, but the second urging diaphragm portion can be fixed on the inner wall 50*a* (second outer block 30) of the second chamber as an independent member with equal effect.

The second urging means 130, 135 constantly urges the second urging diaphragm portion 120 inward, i.e. toward the first pressure application diaphragm portion. According to this embodiment, the second urging means 130, 135, as described in the invention of claim 2, includes a second piston portion 130 arranged in such a manner as to reciprocate while in contact with the second urging diaphragm portion 120 in the second receiving space 125 formed outside of the second urging diaphragm portion 120 of the second outer block 30, and a second spring 135 for urging the second piston portion 130 constantly inward, i.e. toward the first pressure application diaphragm portion. Also, the second piston portion 130 according to this embodiment, like the first piston portion 110, has the end surface 131 on pressure side at the forward end thereof (inside) adapted to contact the second urging diaphragm,portion 120. Numeral 126 in the drawing designates a second vent hole (respiration hole) for discharging the air between the second urging diaphragm portion 120 and the second piston portion 130 out of the body B, numeral 132 a spring mounting opening formed in the second piston portion 130, numeral 136 a second lid portion (second spring receiving portion) for receiving the second spring 135 by closing the opening side of the second receiving space 125, numeral 137 a second discharge hole formed in the second lid portion 136 for discharging the air between the first lid portion 136 and the second piston portion 13 outside, numeral o7 a seal member such as an O-ring interposed between the second piston portion 130 and the second lid portion 136, and numeral o8 a seal member such as an O-ring interposed between the second outer block 30 and the second lid portion 136.

The urging means for urging the urging diaphragm portion 100 or 120 inward are not limited to those illustrated above. For example, each of the aforementioned urging diaphragm portions 100 and 120 may be urged inward under a predetermined pressure by arranging a pressure application space (corresponding to the receiving spaces 105, 125 in this embodiment) outside of the urging diaphragm portion 100 or 120 and supplying a pressured gas from a pressured gas supply unit such as a compressor external to the body B into the pressure application space.

This embodiment, as defined in claim 4 and shown in FIG. 3, is so configured that when the operation of the injector I is stopped, i.e. when the operation of supplying or discharging the working fluid A is stopped, the center position 80*c* of the pressure application mechanism 80 comes to coincide with the intermediate position Sc of the longest reciprocation range (the reciprocation range before stop) of the pressure application mechanism or the neighborhood thereof (the intermediate position Sc in the case under consideration) by the cooperation between the first urging means and the second urging means (as described in detail later). More specifically, in the injector I according to this embodiment, the portions thereof near to the first outer block 30 such as the first chamber 40 and the first pressure application diaphragm portion 81 are located and shaped in symmetric relation with respect to the portions of the injector I near to the second outer block 30 such as the second chamber 50 and the second pressure application diaphragm portion 82. The pressure application mechanism 80 is thus moved in such a manner that when the supply/discharge operation of the working fluid A is stopped, the center position 80c of the pressure application mechanism 80 comes to coincide with the center position of the body B (intermediate block 20), i.e. the intermediate position Sc of the longest reciprocation range S of the pressure application mechanism 80 by the urging force of the first urging means and the second urging means. As a result, when the operation of the injector I is stopped, the pressure application diaphragm portions 81, 82 of the pressure application mechanism 80 are subjected to an equal stress (zero stress for both the diaphragm portions 81, 82 in the case under consideration). Also, according to this embodiment, outer protruded portions 113, 133 protruded outward in the form of a flange are arranged on the outer periphery of the piston portions 110, 130, and stepped portions 107, 127 in contact with the outer protruded portions 113, 133 for restricting the further inward motion of the pistons 110, 130 are arranged on the inner wall of the receiving spaces 105, 125. In the case where the outer protruded portions 113, 133 of the piston portions 110, 130 come into contact with the stepped portions 107, 127 and the pressure application mechanism 80 comes to a complete stop when the supply/discharge of the working fluid A is stopped, therefore, the center position 80*c* of the pressure application mechanism 80 is located at the intermediate position (the center position of the body B) Sc of the longest reciprocation range S. By doing so, even in the case where the elasticity of the first spring and that of the second spring 135 are somewhat different from each other, the pressure application mechanism 80 can be positively stopped with the center position 80*c* thereof at the intermediate position Sc of the longest reciprocation range S when the supply/discharge operation of the working fluid A is stopped. Also, according to this embodiment, the discharge flow rate from the two chambers 40, 50 is set to the same level by equalizing the volumes of the first chamber 40 and the second chamber 50.

The injector I configured as described above operates in the following way. The description that follows refers to the operation performed in the case where the second inlet 33 and the second outlet 34 of the second outer block 30 are closed. Specifically, as shown in FIG. 1, the working fluid A is supplied between the inner wall 40*a* of the first chamber 40 and the inner surface 81*c* of the first pressure application diaphragm portion 81 through the first working fluid influx/outlet portion 91. At the same time, the working fluid A that has been filled between the inner wall 50*a* of the second chamber 50 and the inner surface 82*c* of the second pressure application diaphragm portion 82 is discharged through the second working fluid influx/outlet portion 92. Then, the pressure application mechanism 80 moves toward the first outer block 10. As a result, the pressured fluid F that has thus far been filled between the inner wall 40*a* of the first chamber 40 and the outer surface 81*d* of the first pressure application diaphragm portion 81 is discharged by way of the first outlet 12 through the first discharge portion 42, the first discharge check valve 66 and the first outer outlet portion 14, while at the same time filling the pressured fluid F between the inner wall 50*a* of the second chamber 50 and the outer surface 82*d* of the second pressure application diaphragm portion 82 from the first inlet 11 through the first outer inlet portion 13, the connecting inlet portion 21, the second outer inlet portion 31, the second intake check valve 71 and the second intake portion 51, in preparation for the next discharge operation.

In the initial stage of movement of the pressure application mechanism 80 toward the first outer block 10, the second urging diaphragm portion 120 is brought into contact with the outer surface 82*d* of the second pressure application diaphragm portion by the force of the second spring 135, while at the same time the second piston portion 130 and the second urging diaphragm portion 120 move toward the first outer block 10. Once the center position of the pressure application mechanism 80 comes to coincide with the center position of the body B (intermediate block 20), the outer protruded portion 133 of the second piston portion 130 comes into contact with the second stepped portion 127 of the second receiving space 125. Thus, the movement of the second piston portion 130 and the second urging diaphragm portion 120 toward the first outer block 10 is terminated, and the outer surface 81*d* of the first pressure application diaphragm portion comes into contact with the first urging diaphragm portion 100. After that, upon movement of the pressure application mechanism 80 toward the first outer block 10, the outer surface 82*d* of the second pressure application diaphragm portion moves away from the second urging diaphragm portion 120. At the same time, the first urging diaphragm portion 100 and the first piston portion 110 are moved by being pushed toward the first receiving space 105 by the first pressure application diaphragm portion 81.

On the other hand, as shown in FIG. 2, the working fluid A is supplied between the inner wall 50*a* of the second chamber 50 and the inner surface 82*c* of the second pressure application diaphragm portion 82 through the second working fluid influx/outlet portion 92, and the working fluid A thus far filled between the inner wall 40*a* of the first chamber 40 and the inner surface 81*c* of the first pressure application diaphragm portion 81 is discharged through the first working fluid influx/outlet portion 91. Then, the pressure application mechanism 80 moves toward the second outer block 30. As a result, the pressured fluid F that has been filled between the inner wall 50*a* of the second chamber 50 and the outer surface 82d of the second pressure application diaphragm portion 82 is discharged from the outlet 12 through the second discharge portion 52, the second discharge check valve 76, the second outer outlet portion 32, the connecting outlet portion 22 and the first outer outlet portion 14. At the same time, the pressured fluid F is filled between the inner wall 40*a* of the first chamber 40 and the outer surface 81*d* of the first pressure application diaphragm portion 81 from the inlet 11 through the first outer inlet portion 13, the first intake check valve 61 and the first intake portion 41, in preparation for the next discharge operation.

In the initial stage of movement of the pressure application mechanism 80 toward the second outer block 30, the first urging diaphragm portion 100 is brought into contact with the outer surface 81*d* of the first pressure application diaphragm portion by the force of the first spring 115, while at the same time moving the first piston portion 110 and the first urging diaphragm portion 100 toward the second outer block 30. Once the center position of the pressure application mechanism 80 comes to coincide with the center position of the body B, the outer protruded portion 113 of the first piston portion 110 comes into contact with the first stepped portion 107 of the first receiving space 105, thereby terminating the movement of the first piston portion 110 and the first urging diaphragm portion 100 toward the second outer block 30, while at the same time bringing the outer surface 82*d* of the second pressure application diaphragm portion into contact with the second urging diaphragm portion 120. The subsequent further movement of the pressure application mechanism 80 toward the second outer block 30 causes the outer surface 81*d* of the first pressure application diaphragm portion to come away from the first urging diaphragm portion 100. At the same time, the second urging diaphragm portion 120 and the second piston portion 130 are moved by being pushed toward the second receiving space 125 by the second pressure application diaphragm portion 82.

In the example of the operation shown in FIGS. 1 and 2, the second inlet 33 and the second outlet 34 of the second outer block 30 are closed, while the first inlet 11 of the first outer block 10 is used as an inlet for the pressured fluid F from outside of the injector I, and the first outlet 12 of the first outer block 10 is used as an outlet for the pressured fluid F out of the injector I. However, the invention is not limited to this configuration, but for example, as shown in FIGS. 5 and 6, the injector I may be used with the first outlet 12 and the second inlet 33 closed, or with the first inlet 11 and the first outlet 12 closed, or with the first inlet 11 and the second outlet 34 closed. In other words, while the injector I is in use, one of the first inlet 11 and the second inlet 33 is closed while at the same time closing one of the first outlet 12 and the second outlet 34.

As described above, with the injector I according to this invention, when the pressure application mechanism 80 is in reciprocating motion, the pressure application diaphragm portions 81, 82 of the pressure application mechanism 80 are slowly brought into contact with or away from the urging diaphragm portions 100, 120 urged inward by the urging means 110, 115, 130, 135. Therefore, a buffer effect is attained between the pressure application mechanism 80 and the inner walls 40*a*, 50*a* of the chambers. Thus, as compared with the conventional injector, the service life of the component members such as the pressure application mechanism 80 and the blocks 10, 20, 30 is lengthened. Also, with the injector I according to this invention having the urging mechanism for the pressure application mechanism 80 configured of the urging diaphragm portions 100, 120 and the urging means as described above, at the time of inversion of the pressure application mechanism 80, i.e. at the time of switching the supply/discharge of the working fluid, the pressure application diaphragm portion 81 or 82 near to the chamber next to be supplied with the pressured fluid F is slowly moved inward in contact with the urging diaphragm portion 100 or 120, while at the same time moving somewhat outside the urging diaphragm portion 100 or 120 near to the chamber next to discharge the pressured fluid F, under the pressure of the pressured fluid F. Thus, as will be understood by comparison between FIGS. 7A, 7B showing a graph of the discharge pressure versus time curve in the presence of the urging mechanism and FIGS. 7C, 7D showing a graph of the discharge pressure versus time curve in the absence of the urging mechanism, the internal pressure of the chambers and hence the discharge pressure from the outlet can be prevented from undergoing a sharp change more in the presence of the urging mechanism than in the absence of the urging mechanism. Thus, the service life of the component parts including the pressure application mechanism 80 can be remarkably lengthened.

Further, as described above, when the operation of the injector I is stopped, i.e. when the supply/discharge operation for the working fluid is stopped, the center position 80*c* of the pressure application mechanism 80 is rendered to coincide with the intermediate position (center position of the body B) Sc of the longest reciprocation range S of the pressure application mechanism 80 by the cooperation between the first urging means 110, 115 and the second urging means 130, 135. In this way, since the center of the reciprocating motion and the reciprocation range of the pressure application mechanism 80 remain unchanged before and after stopping the injector, it will be understood from the graphs of FIGS. 7A, 7B that a stable discharge pressure and hence a stable discharge flow rate free of variations is obtained after restarting the operation of the injector as before the stoppage (at the time of normal operation). In the conventional structure free of the urging mechanism, when the injector operation is stopped, the pressure application mechanism may be stopped with the center position of the pressure application mechanism displaced from the intermediate position of the longest reciprocation range of the pressure application mechanism. In such a case, after restart of the injector operation, the pressure application mechanism is reciprocated with the center thereof displaced, resulting in a shorter reciprocation range (more exactly, the distance covered toward one of the chambers). As shown by the chains in FIGS. 7C and 7D, therefore, the discharge pressure and hence the discharge flow rate is changed before and after the stop of the injector I (between normal operation and the restarted operation), while at the same time causing the variation in the discharge flow rate from the chambers 40, 50 after restart of the operation.

The intermediate block 20 of the injector I according to this embodiment is formed of a transparent (or translucent) material as described above, and therefore the operating conditions of the pressure application mechanism 80 can be checked visually from outside. The advantage, therefore, is that any abnormality such as the breakage of the pressure application mechanism 80 or especially the pressure application diaphragm portions 81, 82 can be discovered earlier, and the reciprocation range, i.e. the discharge flow rate of the pressure application mechanism can be easily set by determining the position of inversion of the pressure application mechanism 80. Also, the discharge flow rate can set easier by calibrating the scale on the transparent or translucent intermediate block 20 or otherwise making it easier to check the position of inversion of the reciprocating motion of the pressure application mechanism 80. In the case where the intermediate block 20 is not formed of a transparent or translucent material as described above, on the other hand, detection means such as a CCD or a photosensor can be arranged on the inner walls 40*a*, 50*a* of the chambers 40, 50 to make it possible to check the operating conditions of the pressure application mechanism visually from outside.

FIG. 8 shows an example of an application of the injector I having the structure described above. In this example, the injector I is used as a pressure intensifier for increasing the pressure in a circuit for supplying the pressured fluid F in a tank T1 to a use point U1 by a pump V1. In the shown case, the second inlet 33 and the second outlet 34 of the injector I are closed, the first inlet 11 is connected to the tank T1 through the pump V1, and the first outlet 12 is connected to the use point U2.

FIG. 9 shows another example of application of the injector I having the structure described above. In this example, the injector I is used as what is called the diaphragm pump for supplying a pressured fluid F in a tank T2 to a use point U2. In the shown case, an adjust valve H (see patent Ser. No. 2,671,183) is arranged between the injector I and the use point U2. By doing so, as will be understood from the graph of FIG. 10A showing the relation between time and the discharge pressure of the pressured fluid in the injector I according to this embodiment (in which the supply/discharge of the working fluid is switched by external switching means), the pressure fluid F can be steadily supplied to the use point U2 under a predetermined pressure by setting the pressure z of the adjust valve H at a level lower than the discharge pressure and thus regulating the pressure of the pressured fluid F at a time y when the operation of the pressure application mechanism is inverted. In other words, the pulsation of the discharge pressure can be removed. Also, in the example shown in FIG. 9, the second inlet 33 and the second outlet 34 of the injector I are closed, the first inlet 11 is connected to the tank T2, and the first outlet 12 is connected to the use point U2 through the adjust valve H.

References illustrated in FIGS. 10B to 10D include a graph of FIG. 10B showing the relation between the discharge pressure of the pressured fluid and time in the case where the adjust valve H is not interposed between the injector I according to this embodiment and the use point U2, a graph of FIG. 10C showing the relation between the discharge pressure of the pressured fluid and time in the case where an injector having the conventional structure is used in place of the injector I, and the adjust valve H is not interposed between the injector I and the use point U2, and a graph of FIG. 10D showing the relation between the discharge pressure of the pressured fluid and time in the case where an injector having the conventional structure is used, and the adjust valve H is interposed between the injector I and the use point U2. As seen from the graph of FIG. 10D, in the case where the injector having the conventional structure is used in which the discharge pressure at the time y when the operation of the pressure application mechanism is inverted approximates to 0 and, assuming that the discharge pressure from the injector drops to lower than a level set by the adjust valve H, it becomes impossible to supply the pressured fluid F under a constant pressure to the use point U2 and the pulsation of the discharge pressure remains. The reference character t in FIGS. 10A, 10B designates the switching period of the supply/discharge of the working fluid A for each chamber.

FIG. 11 shows still another example application of the injector I having the above-mentioned structure. In this example, the injector I is used as what is called a diaphragm pump for supplying, under pressure, one of the pressured fluids Fa, Fb in two tanks T3 (arranged in an in-factory circuit), T4. In the shown case, the first outlet 12 of the injector I is closed, and the tank T3 is connected to the first inlet 11 through a first on/off valve (switching valve) V3 and a pump V2, while a tank T4 is connected to the second inlet 33 through a second on/off valve V4, and a use point U3 is connected to the second outlet 34. Then, the pressured fluid Fa in the tank T3 can be supplied under pressure to the use point U3 by opening the first on/off valve V3 and closing the second on/off valve V4, while the pressured fluid Fb in the tank T4 can be supplied under pressure to the use point U3 by opening the second on/off valve V4 and closing the first on/off valve V3. In other words, two types of fluid can be supplied under pressure by a single injector I. Further, though not shown, in the case where one use point is connected to the first outlet 12 through an on/off valve while another use point is connected to the second inlet 33 through an on/off valve, then the fluid can be sent under pressure to two use points with a single injector I by opening/closing the on/off valves.

FIG. 12 shows an injector Ix according to another embodiment of the invention. In the description that follows and FIG. 12, the same component parts as the corresponding parts included in the aforementioned first embodiment above are designated by the same reference numerals, respectively, and will not be described further. In the injector Ix according to this embodiment, like in the invention defined in claim 7, the working fluid A for reciprocating the pressure application mechanism 80 is caused to flow into and from only one of the first chamber 40 and the second chamber 50 (only the second chamber 50 in the shown case), and the chamber in which the fluid is not caused to flow into or from (the first chamber 40 in the shown case) has arranged therein a spring S between the inner wall 40*a* and the inner surface 81*c* of the first pressure application diaphragm portion 81 included in the particular chamber. In this case, a respiration path is provided by the first working fluid influx/outlet portion 91 near to the first chamber 40 which the working fluid A is not caused to flow into or from.

With this configuration, the pressure application mechanism 80 is kept urged to only one of the outer blocks by the spring S. Therefore, the pressure application mechanism 80 can be reciprocated simply by supplying or discharging the working fluid A to or from only one of the chambers 40 and 50, thereby greatly simplifying the operation of controlling the drive of the pressure application mechanism 80. In the case where the working fluid A is supplied to or discharged from only one of the chambers as described above, a three-way solenoid valve driven by an arbitrary periodic on-off signal from a sequencer or a sensor is suitably used as a means for switching the supply and discharge of the working fluid A. Though not shown, on the other hand, the working fluid for reciprocating the pressure application mechanism may be caused to flow into or from the two chambers through the two working fluid influx/outlet portions and a spring may be arranged between the inner wall of each chamber and the inner surface of the pressure application diaphragm portion. Also, in spite of the provision of a total of two each of inlets and outlets for the injector as a whole including the first inlet 11 and the first outlet 12 in the first outer block 10 and the second inlet 33 and the second outlet 34 in the second outer block 30 according to this embodiment, the invention is not confined to such a configuration, but only one inlet and one outlet can be provided for the injector as a whole. In such a case, the inlet and the outlet are both formed in the first outer block 10 or the second outer block 30, or the inlet is formed in the first outer block 10 and the outlet in the second outer block 30, or the inlet is formed in the second outer block 30 and the outlet in the first outer block 10, or otherwise the inlet and the outlet can be formed appropriately in any of the first outer block 10, the intermediate block 20 and the second outer block 30.

Further, the invention is not limited to the aforementioned embodiment configured so that the body B includes three blocks, i.e. the first outer block 10, the intermediate block 20 and the second outer block 30, but the body B can be further segmented like the injector Iy shown in FIG. 13. In the injector Iy shown in FIG. 13, the body By is configured of nine blocks B1 to B9. In FIG. 13, the component members of the injector I identical to the corresponding ones of the embodiment described earlier are designated by the same reference numerals, respectively. The reference character N in FIG. 13 designates bolts for fixing each block.

FIGS. 14 to 17 show an injector Iz and a partial configuration thereof according to still another embodiment of the invention. In the description that follows and FIGS. 14 to 17, the same component parts of the injectors I as those described in the embodiments explained earlier are designated by the same reference numerals, respectively, and will not be described. In the injector Iz according to this embodiment, tubular members P1, P2 embedded in the intermediate block 20 of the body B and constituting the connecting inlet portion 21 and the connecting outlet portion 22 are connected to the first outer block 10 or the second outer block 30 without an intermediary of a seal member such as an O-ring.

The connecting structure will be described in more detail. As will be understood from (1) of FIG. 15 showing in enlarged form the portion designated by numeral 1 of FIG. 14, the end surfaces of the tubular members P1, P2 are formed of a recessed surface Pa having an inner tapered portion Pb, a protruded portion Qa having an outer tapered portion Qb corresponding to the inner tapered portion Pb of the tubular members or the outer outlet portion 14, 32) of the outer wall surface of each of the check valve blocks 60, 65, 70, 75, so that when assembling the check valve blocks 60, 65, 70, 75, the protruded portion M is brought into pressure contact with the inner wall of the check valve block receiving portion of the first outer block 10 or the second outer block 30. As a result, a sufficient sealability can be secured between each of the check valve blocks 60, 65, 70, 75 and the first outer block 10 or the second outer block 30 without a seal member such as an O-ring. In addition, the elimination of the need of the seal member leads to the advantage that the number of parts can be reduced and the check valve blocks 60, 65, 70, 75 can be mounted at a portion composed of only resin such as fluorine contained resin having a high resistance to both corrosion and chemicals. Instead of providing the protruded portion M on the check valve blocks 60, 65, 70, 75 as in the present embodiment, a protruded portion may be formed on the inner wall of the check valve block receiving portion of the first outer block 10 or the second outer block 30.

Further, with the injector Iz according to this embodiment, the intermediate block 20, like the first outer block 10 and the second outer block 30, is composed of resin such as fluorine contained resin having a high resistance to both corrosion and chemicals and, as defined in claim 8, the first lid portion 116 for closing from outside the first receiving space 105 formed outside of the first urging diaphragm portion 100 to accommodate the first piston portion 110 of the first urging means and the second lid portion 136 for closing from outside the second receiving space 125 formed outside of the second urging diaphragm portion 120 to accommodate the second piston portion 130 of the second urging means are formed of a transparent or translucent material such as transparent polyvinyl chloride. By doing so, even in the case where the P1, P2 is formed at the position where the portion of the first outer block 10 or the second outer block 30 is in contact with the tubular members P1, P2 on the side of the intermediate block. As the inner tapered portion Pb of the tubular members P1, P2 comes into pressure contact with the outer tapered portion Qb of the first outer block 10 or the second outer block 30, the tubular members P1, P2 are coupled to the first outer block 10 or the second outer block 30. By doing so, a sufficiently high sealability is secured between the tubular members P1, P2 and the first outer block 10 or the second outer block 30. Further, since the seal member such as an O-ring is eliminated, the number of parts can be reduced, and at the same time, the tubular members P1, P2 can be connected with the first outer block 10 or the second outer block 30 by means of a resin such as a fluorine-containing resin having a high resistance to both corrosion and chemicals. Unlike in the present embodiment having the end surfaces of the tubular members P1, P2 formed with the recessed surface Pa, the invention can alternatively be implemented in such a manner that the end surfaces of the tubular members P1, P2 are formed of a protruded surface having an outer tapered portion, and the first outer block 10 or the second outer block 30 are formed of a recessed surface having an inner tapered portion.

Also, according to this embodiment, the first intake check valve block 60, the first discharge check valve block 65, the second intake check valve block 70 and the second discharge check valve block 75 are assembled on the first outer block 10 or the second outer block 30 of the body B without the intermediary of a seal member such as an O-ring. More specifically, as will be understood from (2) of FIG. 15 showing, in enlarged form, the portion designated by numeral 2 in FIG. 14, a protruded portion M is formed at a predetermined position (the position outside (above or below, in FIG. 14) of the outer inlet portion 13, 31 intermediate block 20 is neither transparent nor translucent, the operation of the first piston portion 110 or the second piston portion 130 can be visually recognized from outside and thus the operating conditions of the pressure application mechanism 80 can be grasped by observing the first lid portion 116 or the second lid portion 136 from the directions of arrows R1, R2 in FIG. 14 and checking the density of the color of the first lid portion 116 or the second lid portion 136. This results in the advantage that any abnormality which may damage the pressure application mechanism 80 can be discovered earlier. Also, in the case where the intermediate block 20 is composed of resin having a high resistance to both corrosion and chemicals, the connecting inlet portion 21 and the connecting outlet portion 22 can be formed directly on the intermediate block 20 without using the tubular members P1, P2, thereby making it possible to reduce the number of the parts required.

With this injector Iz, the urging diaphragm portions 100, 120 are urged by the urging means configured with the piston portions 110, 130 and the springs 115, 135. In the case where a pressured gas is used for urging the urging diaphragm portions 100, 120, however, the use of a transparent or translucent material for the first lid portion 116 and the second lid portion 136 makes it possible to visually recognize the operation of the urging diaphragm portions 100, 120 from outside and thus to grasp the operating conditions of the pressure application mechanism 80.

Also, this injector Iz, as defined in claim 9 or 10 and shown in FIG. 16, comprises working fluid intrusion detection means (210) for detecting whether the working fluid for reciprocating the pressure application mechanism 80 is present or absent in the pressured fluid flowing out of the first outlet 12 or the second outlet 34, and influent fluid properties detection means 211 for detecting the properties of the pressured fluid flowing in from the first inlet 11 or the second inlet 33. Further, according to this embodiment, the influent fluid properties detection means 211 is arranged on an influx pipe member 200 such as a tube mounted on the first inlet 11 through a joint member J1, and the working fluid intrusion detection means 210 is arranged on an outflux pipe member 205 such as a tube mounted on the first outlet 12 through a joint member J2. On the other hand, the second inlet 33 and the second outlet 34 are sealed with seal members J3, J4 (FIG. 14). In FIG. 16, numeral 201 designates a flange return portion formed by folding back the end of the influx pipe member 200 outward of the circumference, numeral 202 a pressure ring interposed between the flange return portion 201 and the joint member J1 of the influx pipe member 200, numeral 206 a flange return portion formed by folding back the end of the outflux pipe member 205 outward of the circumference, and numeral 207 a pressure ring interposed between the flange return portion 206 and the joint member J2 of the outflux pipe member 200. The pipe members 200, 205 according to this embodiment are made of a transparent or translucent tube that can transmit light. The working fluid intrusion detection means 210 and the influent fluid properties detection means 211 will be specifically described below.

The detection means 210, 211 can detect from outside the color, transparency or the like conditions and the state, i.e. the properties of the pressured fluid flowing in the pipe members 200, 205, and are constituted of a photoelectric sensor (beam sensor) of transmission type having a light emitting member 220 and a photodetecting member 221 independent of each other.

The light emitting member 220 and the photodetecting member 221 of the detection means 210, 211 are protected by protective tubes 222, 223. The detection means 210, 211 are fixedly held on the pipe members 200, 205 by a detection means mounting member 225 having a substantially cross section mounted on the pipe members 200, 205, pipe member nuts 226, 227 screwed to the detection means mounting member 225 for pressing the pipe members 200, 205, and detection means nuts 228, 229 screwed to the detection means mounting member 225 for pressing the protective tubes 222, 223. An appropriate method other than the aforementioned method can of course be employed for fixedly holding the detection means 210, 211.

By providing the working fluid intrusion detection means 210 as described above, in case the pressure application diaphragm portions 80, 81 are damaged or degenerated and the working fluid A for reciprocating the pressure application mechanism 80 leaks out of the pressure application diaphragm portion of the chambers 40, 50, the intrusion of the leaking working fluid A into the pressured fluid, if any, can be detected by the working fluid intrusion detection means 210. Therefore, any abnormality of the pressure application mechanism 80 and hence the injector Iz can be discovered at an early time and a protective measure can be taken without delay. Also, provision of the influent fluid properties detection means 211 in addition to the working fluid intrusion detection means 210 makes it possible to determine the abnormality of the leaking fluid, i.e. the intrusion of the working fluid A in relative fashion taking the properties of the influent fluid into consideration, thereby permitting the intrusion of the working fluid A into the pressured fluid to be detected accurately and free of error. This method is applicable especially suitably to the case where a fluid easily subjected to secular variations or a fluid liable to discolor the pipe members 200, 205 such as slurry or chemicals is used as a pressured fluid. Although the aforementioned case refers to the photoelectric sensor of transmission type used as the detection means 210, 211, the invention is not limited to such a sensor, but a photoelectric sensor of a reflection type or other appropriate sensors can be used as the detection means 210, 211 with equal effect.

In addition, the injector Iz, as defined in claim 11 and shown in FIG. 17, comprises leakage detection means 230, 231 for detecting whether the pressured fluid is leaking, due to the damage to or degeneration of the urging diaphragm portions 100, 120, from a first vent hole 106 formed in the first outer block 10 of the body B for discharging the air between the first urging diaphragm portion 100 and the first piston portion 110 of the first urging means out of the body B and a second vent hole 126 formed in the second outer block 30 of the body B for discharging the air between the second urging diaphragm portion 120 and the second piston portion 130 of the second urging means out of the body B. In the shown case, the first vent hole 106 and the second vent hole 126 are connected with leakage detection pipe members 240, 241 such as a tube through joint members J5, J6 so that the fluid which may leak through the vent holes 106, 126 and the leakage detection pipe members 240, 241 is detected by the leakage detection means 230, 231. An explanation will be given below of an example of the leakage detection means 230, 231 used in the case where the pressured fluid is a liquid.

Each leakage detection means 230, 231 according to this embodiment each includes a well-known leaking liquid detection band (leaking liquid sensor) 250 for receiving the fluid from the leakage detection pipe members 240, 241 and a leaking liquid detector (circuit) 255 for detecting the leaking liquid from the output of the leaking liquid detection band 250. The leaking liquid detection band 250 has two conductors arranged in predetermined spaced relationship to each other in an insulating cover which does not cover the side edges of the conductors thereby to partially expose the conductors, and the exposed portions are each configured as a leaking liquid detection electrode. The leaking liquid detector 255 shown in the drawing employs an AC detection method, and includes an oscillation circuit 256 for generating a signal of a predetermined voltage for each predetermined period and a detection circuit 257 for receiving the signal. In the leakage detection means 230, 231 having the aforementioned configuration, as long as the fluid leaks out from the leakage detection pipe members 240, 241 and is in contact with the leaking liquid detection band 250, the leaking liquid detection electrodes of the leaking liquid detection band 250 are electrically shorted to each other and a corresponding detection signal is output. As long as the fluid is not in contact with the leaking liquid detection band 250, on the other hand, the leaking liquid detection electrodes are electrically open, and a corresponding detection signal is output. In this way, it is possible to detect whether the fluid is leaking or not.

With this configuration for detecting the presence or absence of the pressured fluid leaking from the first vent hole 106 and the second vent hole 126 by the leakage detection means 230, 231, any abnormality such as the damage to or degeneration of the urging diaphragm portions 100, 120 can be easily detected at an early time and a protective measure can be taken without delay. The leakage detection means is not limited to the one described above. Other applicable leakage detection means include a configuration in which a sheet of paper is placed on the surface of a plate made of plastics or the like material carrying a black mark or the like in such a manner that the mark on the plate becomes visible through the paper when the fluid comes into contact with the paper, and this change is detected by a well-known photoelectric switch, or a configuration in which the presence or absence or change of the fluid in a container prepared for receiving the fluid from the leakage detection pipe members 240, 241 is detected by a sensor utilizing the refraction characteristic of light. Also, if the pipes are laid by connecting the leakage detection pipe members 240, 241 to the first vent hole 106 and the second vent hole 126 as shown in the aforementioned example, the position of fluid leakage can be determined as desired. Regardless of the leakage position, however, the leakage detection means described above can be arranged without the leakage detection pipe members 240, 241.

The injector according to this invention can be implemented by appropriately modifying the configuration of each of the aforementioned embodiments partially without departing from the spirit and scope of the present invention.

As illustrated and described above, according to this invention, there is provided an injector wherein the sharp change of the internal pressure of each chamber can be prevented by the buffer function of each urging means and each urging diaphragm portion arranged external to the pressure application mechanism in reciprocating motion. At the same time, the service life of the component parts of the pressure application mechanism is lengthened. Especially by configuring the urging means as in claim 2 of the invention, the structure of each urging means can be greatly simplified.

As in the invention of claim 3, the supply and discharge of the working fluid for reciprocating the pressure application. mechanism to and from the first chamber or the second chamber are switched for each predetermined period by external switching means, and the switching period can be arbitrary changed. Thus, the reciprocation range of the pressure application mechanism can be easily changed. As a result, by setting the switching period to shorter than the time required before each diaphragm portion of the pressure application mechanism reaches a stroke end, the pressure application mechanism can be inverted in operation before each diaphragm portion of the pressure application mechanism reaches a stroke end, thereby making it possible to reduce the pulsation of the discharge output which occurs at the time of inversion of the pressure application mechanism. In addition, the discharge flow rate can be easily changed by changing the switching period.

As in the invention of claim 4, the center position of the pressure application mechanism is rendered to coincide with the intermediate position of the longest reciprocation range of the pressure application mechanism or the neighborhood thereof by the cooperation between the first urging means and the second urging means at the time of stopping the operation of supply/discharge of the working fluid. Thus, the same discharge flow rate (discharge output) free of variations can be obtained before and after stopping the operation of the injector.

As in the invention of claim 5, the injector includes two each of inlets and outlets, and one of the two inlets and one of the two outlets is closed in operation, thereby leading to the advantage that the latitude of the layout (piping) of the injector is increased.

As in the invention of claim 6, the body has built therein the first intake check valve block including the first outer inlet portion and the first intake check valve, the first discharge check valve block including the first outer outlet portion and the first discharge check valve, the second intake check valve block including the second outer inlet portion and the second intake check valve, and the second discharge check valve block including the second outer outlet portion and the second discharge check valve. Thus, the component members including the check valves, the pressure application mechanism, the inlet portions and the outlet portions can be all built in the body. As compared with the prior art, therefore, the structure of the body is simplified, the need of segmenting the body into a multiplicity of parts is eliminated and the injector is produced in very compact form.

As in the invention of claim 7, the working fluid for reciprocating the pressure application mechanism is caused to flow into and from only one of the first chamber and the second chamber in the body, and a spring is arranged between the inner wall of the chamber which the working fluid is rendered not to flow into or flow from and the inner surface of the pressure application diaphragm portion arranged in the particular chamber. Then, the pressure application mechanism is urged constantly to one of the outer blocks by the spring. In this way, the pressure application mechanism can be reciprocated simply by supplying or discharging the working fluid to or from one of the chambers, thereby greatly simplifying the operation of controlling the pressure application mechanism.

As in the invention of claim 8, each lid for closing from outside the receiving space for ac carting each urging means is formed of a transparent or translucent material, and therefore the operating conditions of the pressure application mechanism can be visually checked from outside.

As in the invention of claim 9, the injector comprises the working fluid intrusion detection means for detecting the intrusion of the working fluid for reciprocating the pressure application mechanism, into the pressured fluid flowing out from the outlet open and used, wherein the leakage of the working fluid for reciprocating the pressure application mechanism due to the damage to the pressure application diaphragm or the like can be detected by the particular detection means. Thus, any abnormality of the pressure application mechanism and hence the injector can be discovered easily at an early time and a protective measure can be carried out quickly.

As in the invention of claim 10, the injector comprises, in addition to the working fluid intrusion detection means, the inflowing fluid properties detection means for detecting the properties of the pressure fluid flowing in by way of the inlet open and in use. Thus, the intrusion of the working fluid into the pressured fluid can be determined in relative fashion taking the properties of the pressured fluid flowing in by way of the inlet into consideration, thereby further improving the accuracy at which the intruding working fluid is detected.

As in the invention of claim 11, the injector comprises the leakage detection means for detecting whether the pressured fluid is leaking from any of the vent holes formed for discharging the air between each urging diaphragm portion and the piston portion of each urging means. Thus, any abnormality of the injector such as the damage to the urging diaphragm portions can be easily discovered at an early time, and an appropriate protective measured can be taken quickly.

What is claimed is:

1. An injector (I) comprising a body (B) including therein:

a first outer inlet portion (13) for a fluid to be sent under pressure (F);

a first outer outlet portion (14) for the fluid sent under pressure;

a connecting inlet portion (21) communicating with the first outer inlet portion;

a connecting outlet portion (22) communicating with the first outer connecting outlet portion;

a second outer inlet portion (31) communicating with the connecting inlet portion;

a second outer outlet portion (32) communicating with the connecting outlet portion;

a first chamber (40) including a first intake portion (41) communicating with the first outer inlet portion and a first discharge portion (42) communicating with the first outer outlet portion;

a second chamber (50) including a second intake portion (51) communicating with the second outer inlet portion and a second discharge portion (52) communicating with the second outer outlet portion;

a first intake check valve (61) interposed between the first outer inlet portion and the first intake portion for causing the pressured fluid to flow toward the first intake portion;

a first discharge check valve (66) interposed between the first discharge portion and the first outer outlet portion for causing the pressured fluid to flow toward the first outer outlet portion;

a second intake check valve (71) interposed between the second outer inlet portion and the second intake portion for causing the pressured fluid to flow toward the second intake portion;

a second discharge check valve (76) interposed between the second discharge portion and the second outer outlet portion for causing the pressured fluid to flow toward the second outer outlet portion;

a pressure application mechanism (80) including a first pressure application diaphragm portion (81) with the outer peripheral portion thereof fixed on the inner wall (40*a*) of the first chamber and a second pressure application diaphragm portion (82) with the outer peripheral portion thereof fixed on the inner wall (50*a*) of the second chamber, the first pressure application diaphragm portion (81) and the second pressure application diaphragm portion (82) being arranged to be integrally movably by a coupling (83);

a working fluid influx/outlet portion (90) open to at least one of the first chamber and the second chamber for causing a working fluid (A) for reciprocating the pressure application mechanism to flow into or flow from at least one of the first chamber and the second chamber;

a first urging diaphragm portion (100) arranged on the outer wall surface (40*b*) of the inner wall of the first chamber for pressing the first pressure application diaphragm portion toward the second pressure application diaphragm portion when coming into contact with the outer surface of the first pressure application diaphragm portion; first urging means for keeping the first urging diaphragm portion urged toward the second pressure application diaphragm portion;

a second urging diaphragm portion (120) arranged on the outer wall surface (50*b*) of the inner wall of the second chamber for pressing the second pressure application diaphragm portion toward the first pressure application diaphragm portion when coming into contact with the outer surface of the second pressure application diaphragm portion; and second urging means for keeping the second urging diaphragm portion urged toward the first pressure application diaphragm portion.

2. An injector according to claim 1, wherein the first urging means includes a first piston portion (110) arranged in a first receiving space (105) outside of the first urging diaphragm to be reciprocated in contact with the first urging diaphragm portion, and a first spring (115) for keeping the first piston portion urged toward the second pressure application diaphragm portion, and wherein the second urging means includes a second piston portion (130) arranged in a second receiving space (125) outside of the second urging diaphragm portion to be reciprocated in contact with the second urging diaphragm portion, and a second spring (135) for keeping the second piston portion urged toward the first pressure application diaphragm portion.

3. An injector according to claim 2, wherein the body is formed with a first vent hole (106) for discharging outside of the body the air between the first urging diaphragm portion and the first piston portion and a second vent hole (126) for discharging outside of the body the air between the second urging diaphragm portion and the second piston portion, the injector further comprising leakage detection means (230, 231) for detecting the presence or absence of the pressured fluid leaking from the first vent hole or the second vent hole.

4. An injector according to claim 1, wherein the supply and discharge of the working fluid for reciprocating the pressure application mechanism to and from the first chamber or the second chamber is switched for a predetermined switching period by an external switching means, which switching period can be arbitrarily changed.

5. An injector according to claim 1, wherein the center position of the pressure application mechanism is rendered to coincide with the intermediate position of the longest reciprocation range of the pressure application mechanism or the neighborhood thereof by the cooperation between the first urging means and the second urging means at the time of stopping the supply or discharge of the fluid.

6. An injector according to claim 1, further comprising a first inlet (11) communicating with the first outer inlet portion, a first outlet (12) communicating with the first outer outlet portion, a second inlet (33) communicating with the second outer inlet portion, and a second outlet (34) communicating with the second outer outlet portion, wherein one of the first inlet and the second inlet is closed and one of the first outlet and the second outlet is closed while the injector is in operation.

7. An injector according to claim 1, wherein the body has built therein a first intake check valve block (60) including the first outer inlet portion and the first intake check valve, a first discharge check valve block (65) including the first outer outlet portion and the first discharge check valve, a second intake check valve block (70) including the second outer inlet portion and the second intake check valve, and a second discharge check valve block (75) including the second outer outlet portion and the second discharge check valve.

8. An injector according to claim 1, wherein the working fluid for reciprocating the pressure application mechanism flows into and from only one of the first chamber and the second chamber, the injector further comprising a spring (140) interposed between the inner wall of the chamber which no working fluid flows into or from and the inner surface of the pressure application diaphragm portion arranged in the particular chamber.

9. An injector according to claim 1, further comprising a first lid portion (116) for closing from outside the first receiving space formed outside of the first urging diaphragm portion to receive the first urging means and a second lid portion (136) for closing from outside the second receiving space formed outside of the second urging diaphragm portion to receive the second urging means, the first lid portion (116) and the second lid portion (136) being form of a transparent or translucent material.

10. An injector according to claim 1, comprising a first inlet communicating with the first outer inlet portion, a first outlet communicating with the first outer outlet portion, a second inlet communicating with the second outer inlet portion, a second outlet communicating with the second outer outlet portion, and working fluid intrusion detection means (210) for detecting the intrusion of the working fluid into the fluid flowing out from the first outlet or the second outlet.

11. An injector according to claim 10, further comprising influent fluid properties detection means (211) for detecting the properties of the fluid flowing in from the first inlet or the second inlet.

* * * * *